US008918001B2

(12) United States Patent
Kurata et al.

(10) Patent No.: US 8,918,001 B2
(45) Date of Patent: Dec. 23, 2014

(54) FIXING APPARATUS

(75) Inventors: Munehito Kurata, Suntou-gun (JP); Daizo Fukuzawa, Mishima (JP); Noriaki Sato, Suntou-gun (JP); Kuniaki Kasuga, Mishima (JP); Tomonori Sato, Gotemba (JP); Mahito Yoshioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/484,850

(22) Filed: May 31, 2012

(65) Prior Publication Data

US 2012/0308253 A1 Dec. 6, 2012

(30) Foreign Application Priority Data

Jun. 2, 2011 (JP) ..... 2011-124162

(51) Int. Cl.
*G03G 15/20* (2006.01)

(52) U.S. Cl.
CPC ..... *G03G 15/2042* (2013.01)
USPC ..... 399/69; 399/328; 399/334; 219/216

(58) Field of Classification Search
USPC ..... 399/69, 320, 328, 329, 334; 219/216
See application file for complete search history.

(56) References Cited

U.S. PATENT DOCUMENTS 6,713,725 B2 3/2004 Izawa et al.
7,193,181 B2 * 3/2007 Makihira et al. ..... 219/216
7,630,662 B2 12/2009 Namiki et al.
2003/0029853 A1 2/2003 Izawa et al.
2004/0208665 A1 * 10/2004 Takematsu ..... 399/69
2007/0183805 A1 * 8/2007 Tsukada ..... 399/69
2010/0316404 A1 12/2010 Fukuzawa et al.
2011/0150545 A1 6/2011 Nihonyanagi et al.
2011/0200837 A1 * 8/2011 Yoshizawa et al. ..... 428/500
2012/0148281 A1 6/2012 Fukuzawa et al.
2012/0328318 A1 * 12/2012 Ogiso et al. ..... 399/70

FOREIGN PATENT DOCUMENTS

JP 2002-341682 A 11/2002
JP 2010-145835 A 7/2010

* cited by examiner

*Primary Examiner* — Francis Gray
(74) *Attorney, Agent, or Firm* — Fitzpatrick, Cella, Harper & Scinto

(57) ABSTRACT

A fixing apparatus includes: two rotatable members, for forming a nip, including a region where an outer diameter is increased from a longitudinal central portion toward a longitudinal end portion; a heater; and a controller for controlling a heat generation distribution of the heater. The controller is capable of controlling the heater so that the heat generation distribution of the heater is such that a heat generation amount at the longitudinal end portion is larger than that at the longitudinal central portion in a period from start of the heater until the recording material reaches the nip. A ratio of the heat generation amount at the longitudinal end portion to that at the longitudinal central portion is larger when a cumulative amount of use of the fixing apparatus is larger than a predetermined amount than when the cumulative amount of use is smaller than the predetermined amount.

24 Claims, 10 Drawing Sheets

FIXING APPARATUS

FIELD OF THE INVENTION AND RELATED ART

The present invention relates to a fixing apparatus (device) to be mounted in an image forming apparatus such as an electrophotographic copying machine or an electrophotographic printer.

This fixing apparatus a heater which includes a ceramic substrate and an energization heat generating resistor formed on the substrate, a cylindrical fixing film movable in contact with the heater, and a pressing roller for forming a nip between the pressing roller and the fixing film contacted to the heater. A recording material for carrying an unfixed toner image is heated while being nip-conveyed in the nip of the fixing apparatus, so that the toner image on the recording material is heat-fixed on the recording material. This fixing apparatus uses, as the fixing film, a member with a low thermal capacity, thus having the advantage such that a time required from start of energization to the heater until a temperature of the heater is increased up to a fixable temperature is short. Therefore, the printer in which the fixing apparatus is mounted can shorten a time from input of a print command to output of an image on a first sheet of the recording material (FPOT: first printout time). Further, the fixing apparatus has also the advantage such that power consumption during stand-by in which the printer awaits the print command is less.

Incidentally, the fixing apparatus using a fixing film has the constitution in which the thermal capacity is small and therefore a temperature of the fixing film at an end portion with respect to a direction (longitudinal direction) perpendicular to a recording material conveyance direction is liable to be increased. This is because when the recording material is subjected to continuous printing, heat of the heater is consumed by fixing of a toner image on the recording material with respect to the longitudinal direction within a conveyance region of the recording material but is not consumed within a non-conveyance region of the recording material. Thus, there arose a problem such that the temperature is abnormally increased at the longitudinal end portion of the fixing film, i.e., that a so-called non-sheet-passing portion temperature rise occurs.

Further, in the case where a fixing operation is started from a state in which the fixing apparatus is sufficiently cooled, the fixing nip is heated by the heat of the heater but the longitudinal end portion of the fixing film is liable to dissipate the heat. Therefore, there was also a problem that fixing property of the fixing film at the longitudinal end portion is poorer than that at a longitudinal central portion of the fixing film when the recording material enters the fixing apparatus.

In order to solve the problems described above, in Japanese Laid-Open Patent Application (JP-A) 2002-341682, two energization heat generating resistor layers which are independently energizable are formed on the heater, and an amount of heat generation of one of the two energization heat generating resistor layers is made larger than that of the other energization heat generating resistor layer. Further, an energization ratio between the two energization heat generating resistor layers is changed, so that a longitudinal temperature distribution of the heater during passing of the recording material is adjusted.

That is, in the fixing apparatus, when a plurality of sheets of the recording material are continuously passed through the fixing apparatus, an initial energization ratio between the energization heat generating resistor is determined depending on a width of the recording material with respect to the direction perpendicular to the recording material conveyance direction. A method of determining the energization ratio is such that the energization ratio of energization to the energization heat generating resistor layer having a large amount of heat generation at the longitudinal end portion to energization to the energization heat generating resistor layer having a small amount of heat generation at the longitudinal end portion is increased with a larger width of the recording material. Further, depending on the number of sheets subjected to the passing, the energization ratio of energization to the energization heat generating resistor layer having the large amount of heat generation at the longitudinal end portion to energization to the energization heat generating resistor layer having the small amount of heat generation at the longitudinal end portion is stepwisely decreased. As a result, at an initial stage when the recording material is passed through the fixing apparatus, an insufficient heat quantity at the longitudinal end portion and excessive temperature rise at the non-sheet-passing portion during the continuous sheet passing are suppressed.

As the pressing roller in the fixing apparatus of the film heating type as described above, a pressing roller formed in a shape having a region where its outer diameter is increased from its longitudinal central portion toward its longitudinal end portion, i.e., formed in a so-called reverse crown shape is used in some cases. This is because distortion and flexure of the recording material in the fixing nip are eliminated by conveying the recording material through the fixing nip at the longitudinal end portion relatively faster than the longitudinal central portion when the recording material is nip-conveyed through the fixing nip, so that an occurrence of creases of paper is suppressed.

However, even when the pressing roller is formed in the reverse crown shape, the creases of paper occurred in the case where the recording material takes up moisture and the case where a basis weight of the recording material is small.

FIG. 16 shows a longitudinal detect shape of a pressing roller, at the time of a brand-new state, used in a conventional fixing apparatus and shows a longitudinal outer diameter shape of the pressing roller after it is incorporated in the conventional fixing apparatus and then is subjected to passing of the recording material on 200,000 sheets. In FIG. 16, measurement of the longitudinal outer diameter shape of the pressing roller was made in a room temperature state, i.e., a state in which the pressing roller was sufficiently cooled. In FIG. 16, the ordinate represents a difference in outer diameter of a measured position from a longitudinal center of the pressing roller, and the abscissa represents a distance of the measured position from the longitudinal center of the pressing roller with respect to the longitudinal direction of the pressing roller. The pressing roller has a symmetrical shape on the basis of the longitudinal center of the pressing roller with respect to the longitudinal direction and therefore data shown in FIG. 16 are those in a region ranging from the longitudinal center to one of longitudinal ends of the pressing roller.

As shown in FIG. 16, the longitudinal outer diameter shape of the pressing roller at the time of the brand-new state is a beautiful reverse crown shape, so that an outer diameter difference of the longitudinal end portion from the longitudinal center is large in a necessary and sufficient manner. On the other hand, with respect to the longitudinal outer diameter shape of the pressing roller after the sheet passing on 200,000 sheets, it is understood that the outer diameter difference of the longitudinal end portion from the longitudinal center is smaller, than that at the time of the brand-new state, with a distance closer to the longitudinal end of the pressing roller. That is, with an increasing cumulative amount of use of the fixing apparatus, the outer diameter difference between the longitudinal end portion and the longitudinal central portion becomes small compared with that at the time of the brand-new state.

This is caused by a phenomenon that the pressing roller is subjected to the sheet passing for a long time in a higher temperature state with speed-up and life time extension of the printer in recent years and therefore the pressing roller is plastically deformed by thermal damage to cause a change in outer diameter shape. Particularly, the end portion of the pressing roller with respect to the direction perpendicular to the recording material conveyance direction is liable to become the higher temperature state than the central portion due to the non-sheet-passing portion temperature rise and receives large pressure correspondingly to the large outer diameter based on the reverse crown shape and therefore the pressing roller is liable to be plastically deformed.

Thus, in the case where the pressing roller having the outer diameter difference, between the longitudinal end portion and the longitudinal central portion, smaller than that at the initial stage is subjected to the sheet passing of the recording material which takes up moisture, in some cases, the creases of paper were liable to occur. Here, the central portion of the pressing roller refers to a region in which a distance from the longitudinal center ranges from 0 mm to 90 mm, and the longitudinal end portion refers to a region in which the distance from the longitudinal center ranges from 90 mm to 110 mm.

In order to prevent the occurrence of the paper crease even when sheets of the recording material in an unexpected number are passed through the fixing apparatus, it would be considered that an initial outer diameter difference between the longitudinal central portion and the longitudinal end portion of the pressing roller is increased in advance.

However, in this case, at an initial stage of use of the fixing apparatus, a difference in recording material conveyance speed between the longitudinal central portion and the longitudinal end portion of the pressing roller is excessively increased, so that image defect such as friction image with the fixing film at a widthwise end portion of the recording material can occur. Further, when the difference in recording material conveyance speed is excessively large, there was a problem that distortion of the fixing film is generated. That is, the reverse crown shape (outer diameter difference between the longitudinal central portion and the longitudinal end portion) of the pressing roller causes the problems even when a degree thereof is excessively large and excessively small and therefore the reverse crown shape of the pressing roller is required to be properly maintained irrespective of a cumulative amount of use of the fixing apparatus.

Further, as the case where the paper crease is liable to occur, there is the case where the recording material is passed through the fixing apparatus from a state in which the fixing apparatus is sufficiently cooled to a room temperature state (25° C.). In such a case, the entire fixing apparatus is in a cooled state and therefore heat generated by energizing the energization heat generating resistor layers of the heater heats the fixing nip via the fixing film but is escaped from the longitudinal end portion of the heater by heat dissipation.

For that reason, a longitudinal temperature distribution of the pressing roller immediately before the recording material enters the fixing apparatus is in a state in which the temperature is high at the longitudinal central portion and is low at the longitudinal end portion. In this case, a change in outer diameter due to thermal expansion is large at the longitudinal central portion and is small at the longitudinal end portion. That is, the pressing roller is expanded so as to cancel the reverse crown shape (larger outer diameter of the longitudinal end portion than the longitudinal central portion). For that reason, the paper crease is liable to occur.

In the constitution in JP-A 2002-341682, when a longitudinal heat generation distribution of the heater at an initial stage of continuous sheet passing of the recording material is such that the amount of heat generation is excessively large, in the case where the reverse crown shape of the pressing roller is already decreased in degree of outer diameter increase in the room temperature state, the reverse crown shape can be restored by the thermal expansion. For that reason, such a heat generation distribution is effective in preventing the occurrence of the paper crease.

However, in the case where the fixing apparatus is not subjected to the sheet passing of the recording material as yet and the pressing roller keeps its reverse crown shape sufficiently in the room temperature state, the amount of heat generation at the longitudinal end portion of the heater is excessively large, so that the longitudinal end portion of the pressing roller is excessively expanded. In this case, as described above, the recording material conveyance speed at the longitudinal end portion of the pressing roller was excessively higher than that at the longitudinal central portion and thus there was the case where the problem such as the friction image with the fixing film arose.

SUMMARY OF THE INVENTION

A principal object of the present invention is to provide a fixing apparatus, including a rotatable member having a reverse crown shape such that an outer diameter of a longitudinal end portion is larger than an outer diameter of a central portion, capable of properly maintaining the reverse crown shape of the rotatable member to suppress an occurrence of creases of a recording material and an occurrence of an image defect irrespective of a cumulative amount of use of the fixing apparatus.

According to an aspect of the present invention, there is provided a fixing apparatus for fixing a toner image on a recording material by heating the toner image while conveying the recording material in a nip, the fixing apparatus comprising: a pair of rotatable members for forming the nip, wherein at least one of the pair of rotatable members has a region where an outer diameter is increased from a longitudinal central portion toward a longitudinal end portion; a heater, having a variable heat generation distribution with respect to a longitudinal direction, for heating the pair of rotatable members; and a controller for controlling the heat generation distribution of the heater with respect to the longitudinal direction, wherein the controller is capable of controlling said heater so that the heat generation distribution of the heater is such that an amount of heat generation at the longitudinal end portion is larger than that at the longitudinal central portion at least in a period from start of said heater until the recording material reaches the nip, wherein a ratio of the amount of heat generation at the longitudinal end portion to that at the longitudinal central portion is larger when a cumulative amount of use of the fixing apparatus is larger than a predetermined amount than when the cumulative amount of use is smaller than the predetermined amount.

According to another aspect of the present invention, there is provided a fixing apparatus for fixing a toner image on a recording material by heating the toner image while conveying the recording material in a nip, the fixing apparatus comprising: a pair of rotatable members for forming the nip, wherein at least one of the pair of rotatable members has a region where an outer diameter is increased from a longitudinal central portion toward a longitudinal end portion; a heater, having a variable heat generation distribution with respect to a longitudinal direction, for heating the pair of rotatable members; and a controller for controlling the heat generation distribution of the heater with respect to the longitudinal direction, wherein the controller is capable of controlling said heater so that the heat generation distribution of the heater is such that an amount of heat generation at the longitudinal end portion is larger than that at the longitudinal central portion at least in a period from start of the heater until the recording material reaches the nip, wherein a ratio of the amount of heat generation at the longitudinal end portion to that at the longitudinal central portion is larger when a cumulative number of thermal history of the fixing apparatus is larger than a predetermined amount than when the cumulative number of thermal history is smaller than the predetermined amount.

According to the present invention, it is possible to provide the fixing apparatus capable of suppressing the occurrence of the creases of the recording material and the occurrence of the image defect irrespective of the cumulative amount of use of the fixing apparatus.

These and other objects, features and advantages of the present invention will become more apparent upon a consideration of the following description of the preferred embodiments of the present invention taken in conjunction with the accompanying drawings.

Figure 2:
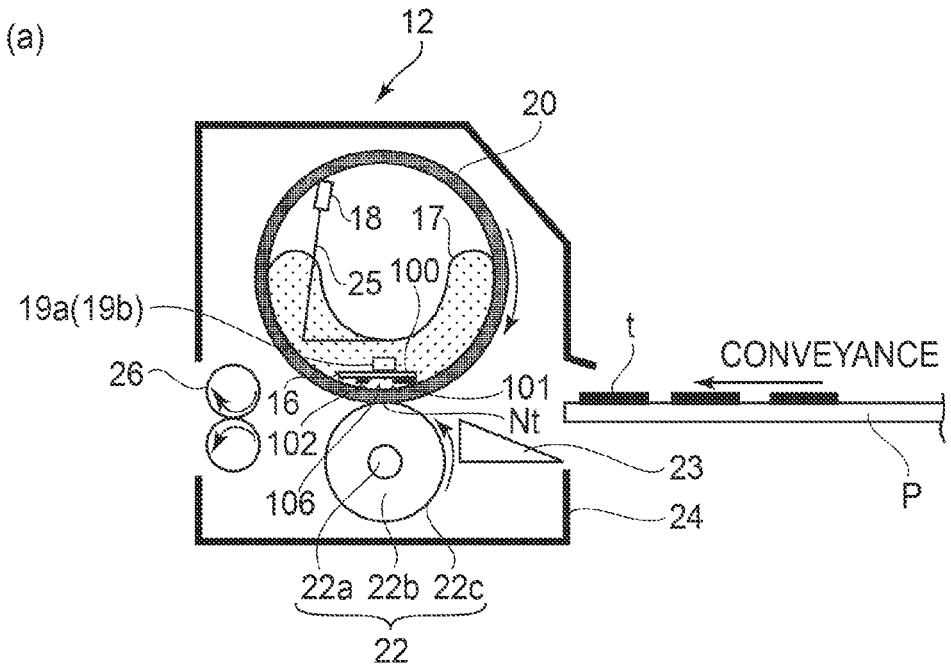
Figure 2:
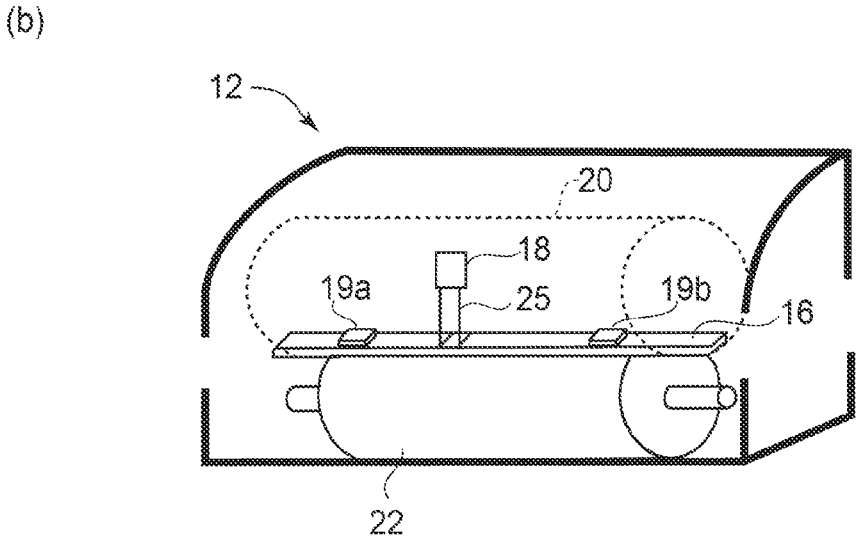

Part (a) of FIG. 2 is a schematic sectional view of a fixing apparatus, and (b) of FIG. 2 is a perspective view of the fixing apparatus.

Figure 3:
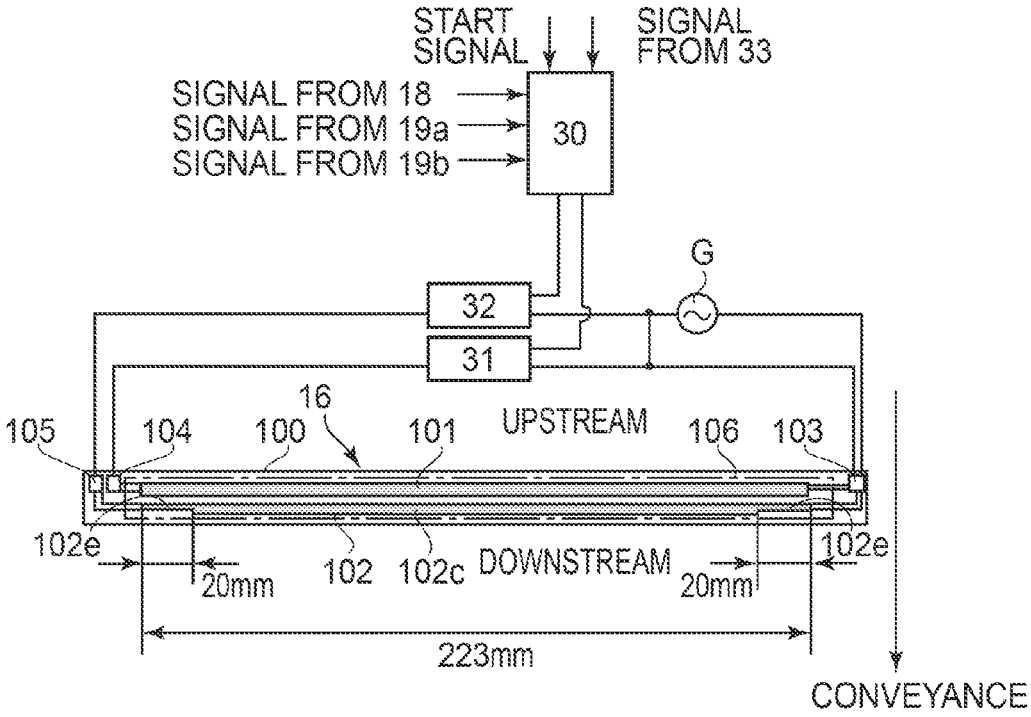

FIG. 3 includes a schematic illustration of a heater and a block diagram of an energization control system of the heater.

Figure 4:
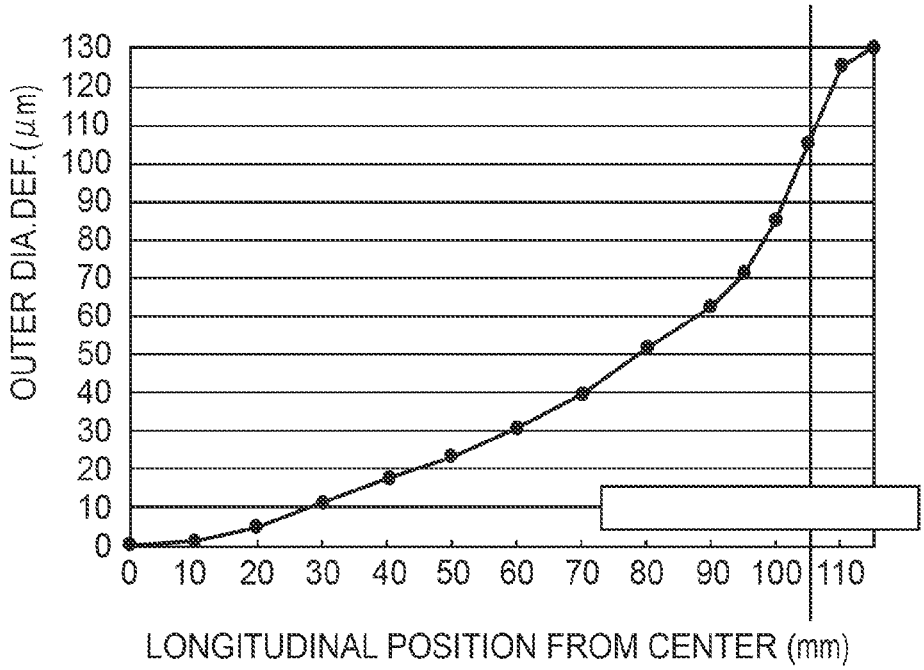

FIG. 4 is a graph for illustrating an outer diameter shape of a pressing roller with respect to a longitudinal direction.

Figure 5:
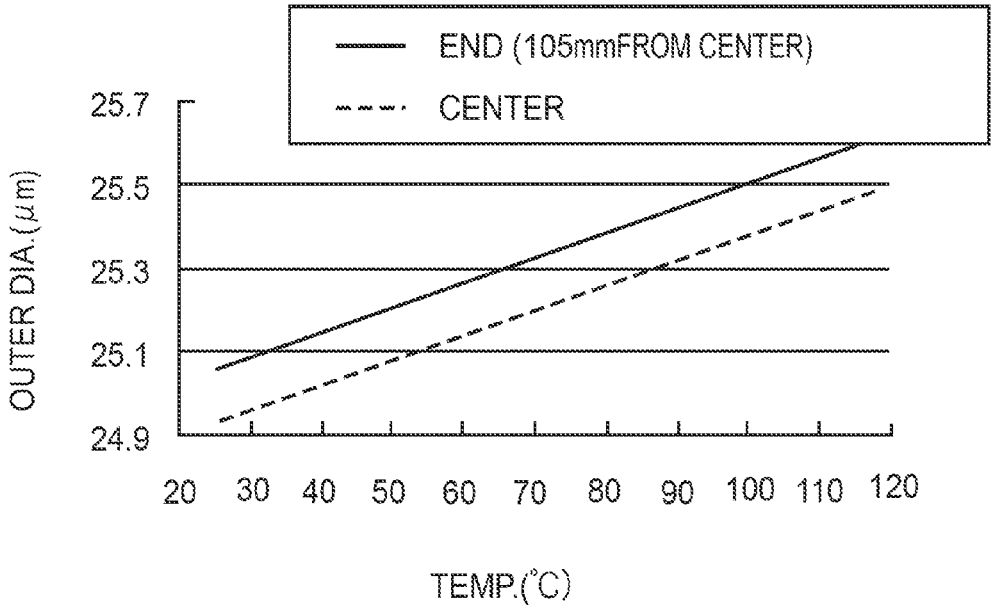

FIG. 5 is a graph for illustrating thermal expansion of the outer diameter shape of the pressing roller.

Figure 6:
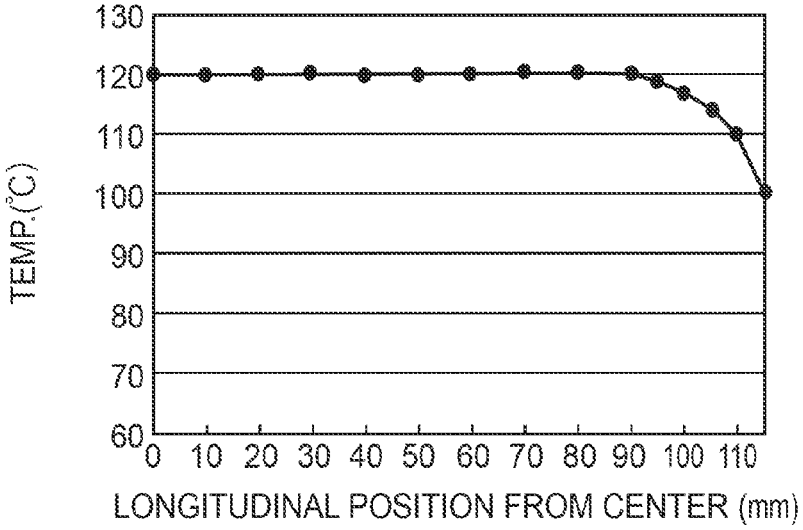

FIG. 6 is a graph showing a longitudinal temperature distribution of the pressing roller immediately before a recording material enters a fixing nip.

Figure 7:
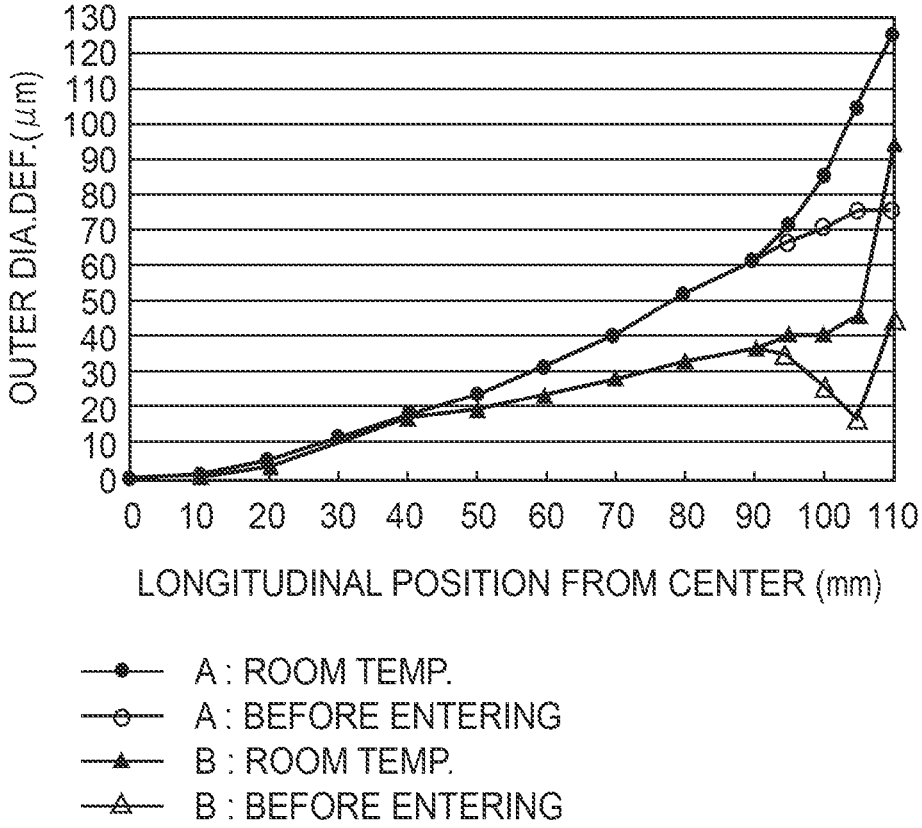

FIG. 7 is a graph for illustrating the outer diameter shape of the pressing roller with respect to the longitudinal direction immediately before the recording material enters the fixing nip.

Figure 8:
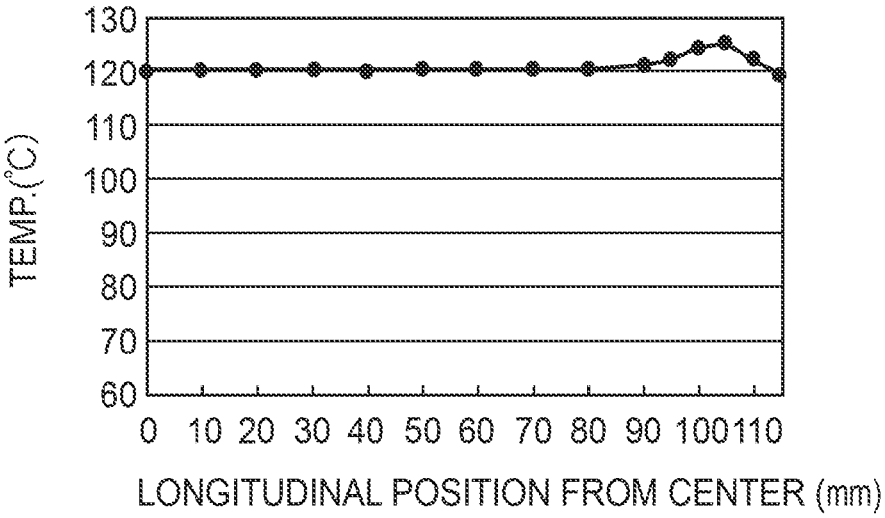

FIG. 8 is another graph showing a longitudinal temperature distribution of the pressing roller immediately before the recording material enters the fixing nip.

Figure 9:
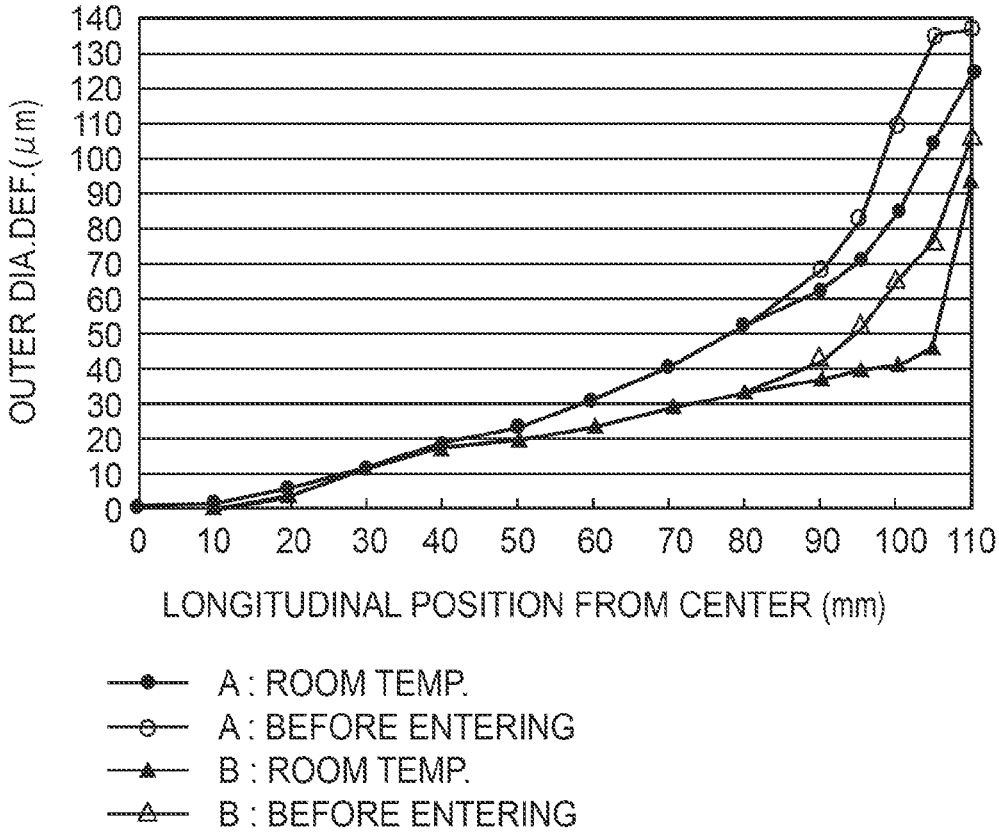

FIG. 9 is another graph for illustrating the outer diameter shape of the pressing roller with respect to the longitudinal direction immediately before the recording material enters the fixing nip.

Figure 10:
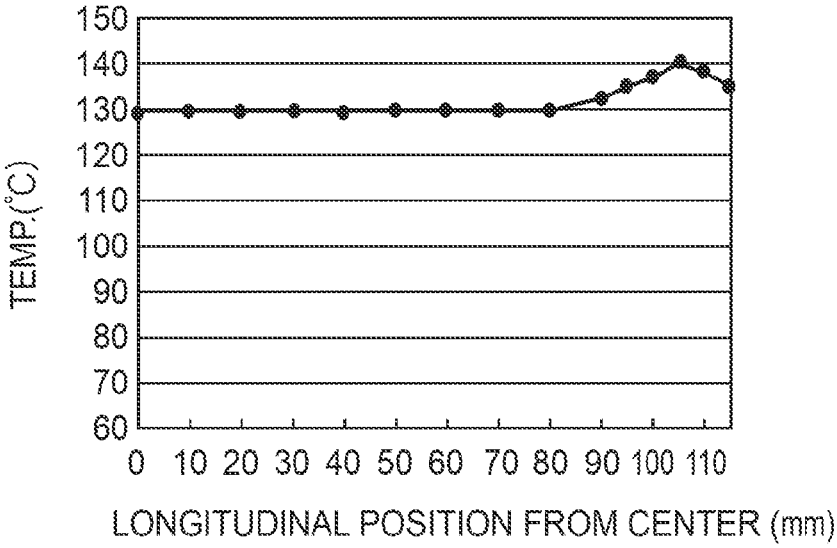

FIG. 10 is another graph showing a longitudinal temperature distribution of the pressing roller immediately before the recording material enters the fixing nip.

Figure 11:
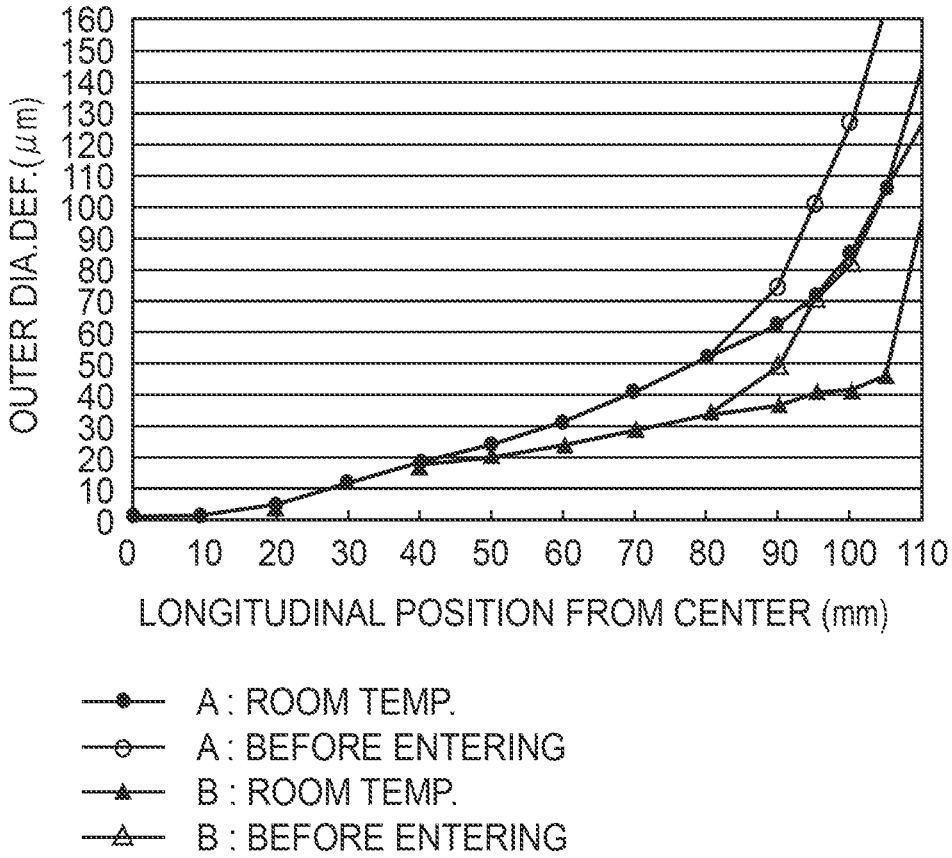

FIG. 11 is another graph for illustrating the outer diameter shape of the pressing roller with respect to the longitudinal direction immediately before the recording material enters the fixing nip.

Figure 12:
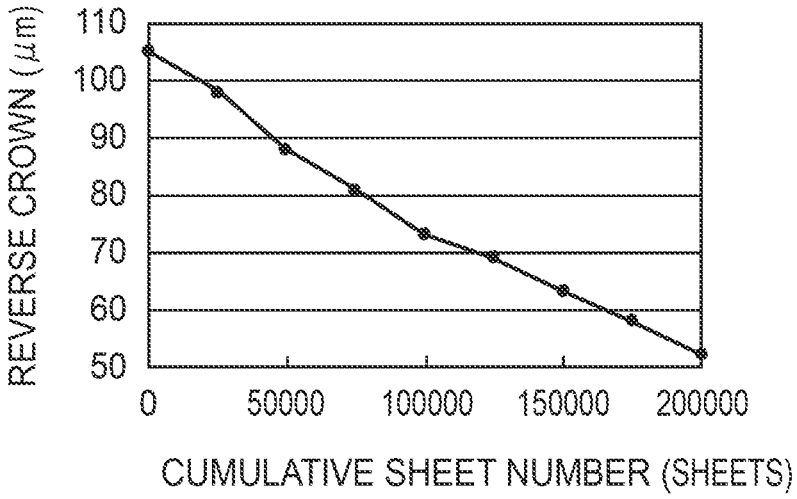

FIG. 12 is a graph showing a decrease in degree of reverse crown of the pressing roller with the sheet passing of the recording material.

Figure 13:
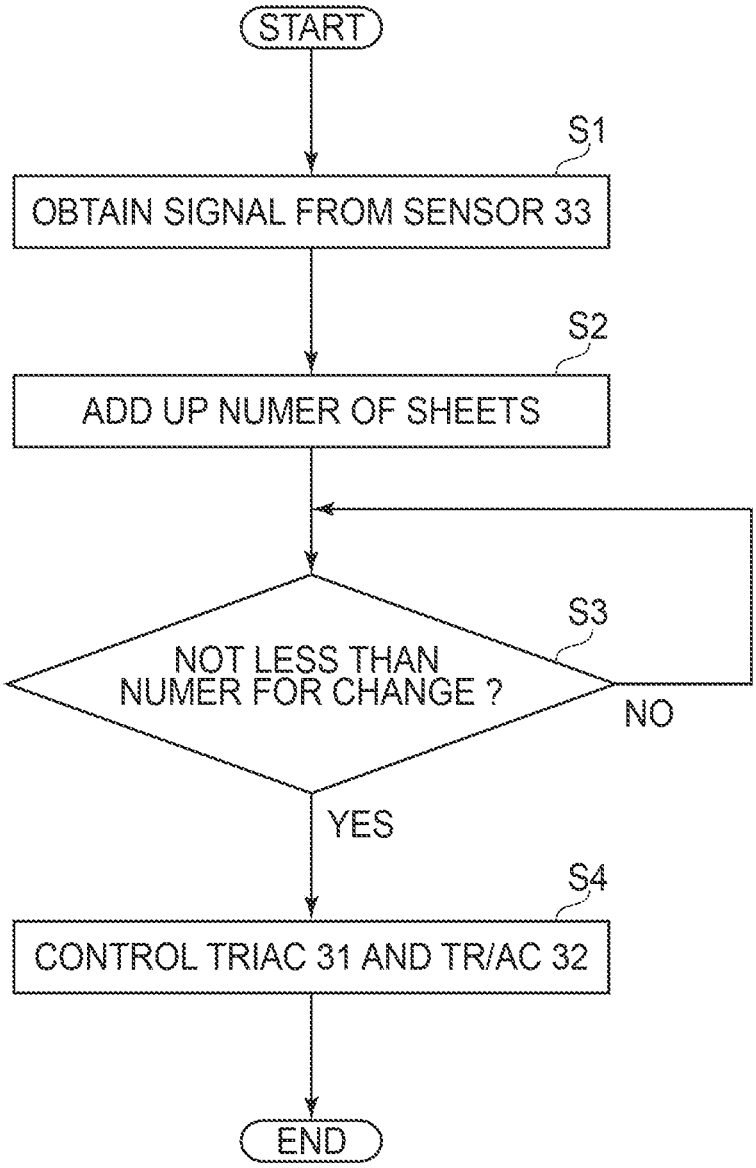

FIG. 13 is a flow chart of control of the heat of the fixing apparatus in Embodiment 1.

Figure 14:
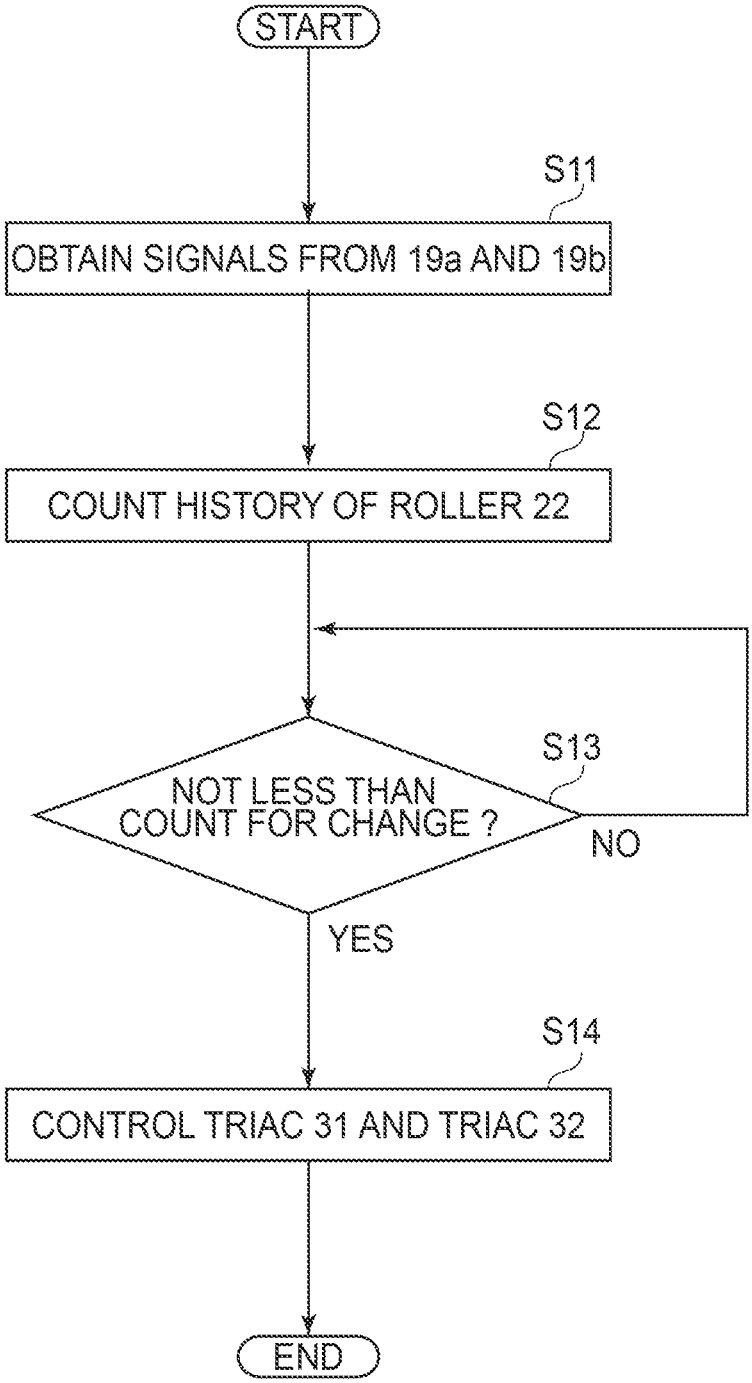

FIG. 14 is a flow chart of control of a heater of a fixing apparatus in Embodiment 2.

Figure 15:
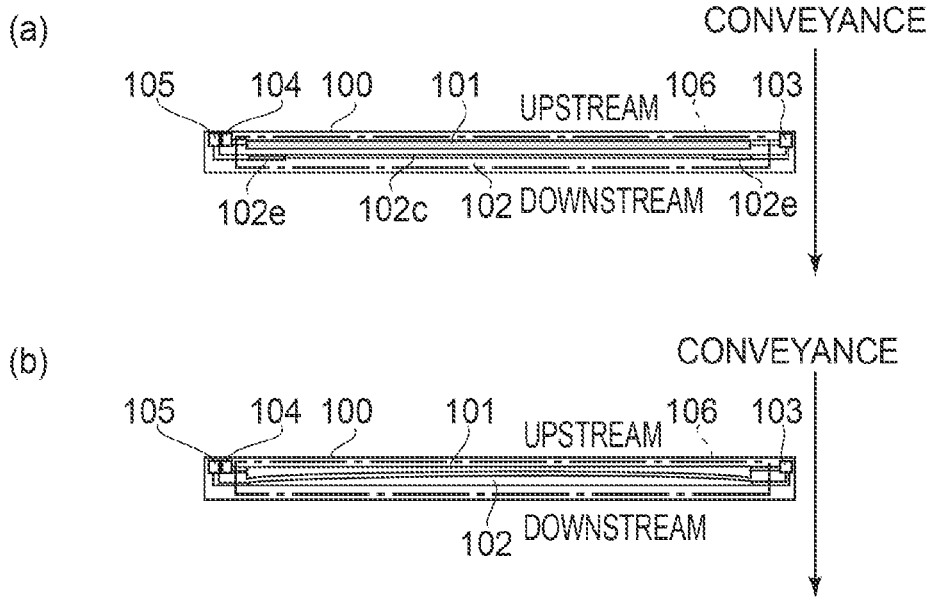

Parts (a) and (b) of FIG. 15 are modified examples of the heater.

Figure 16:
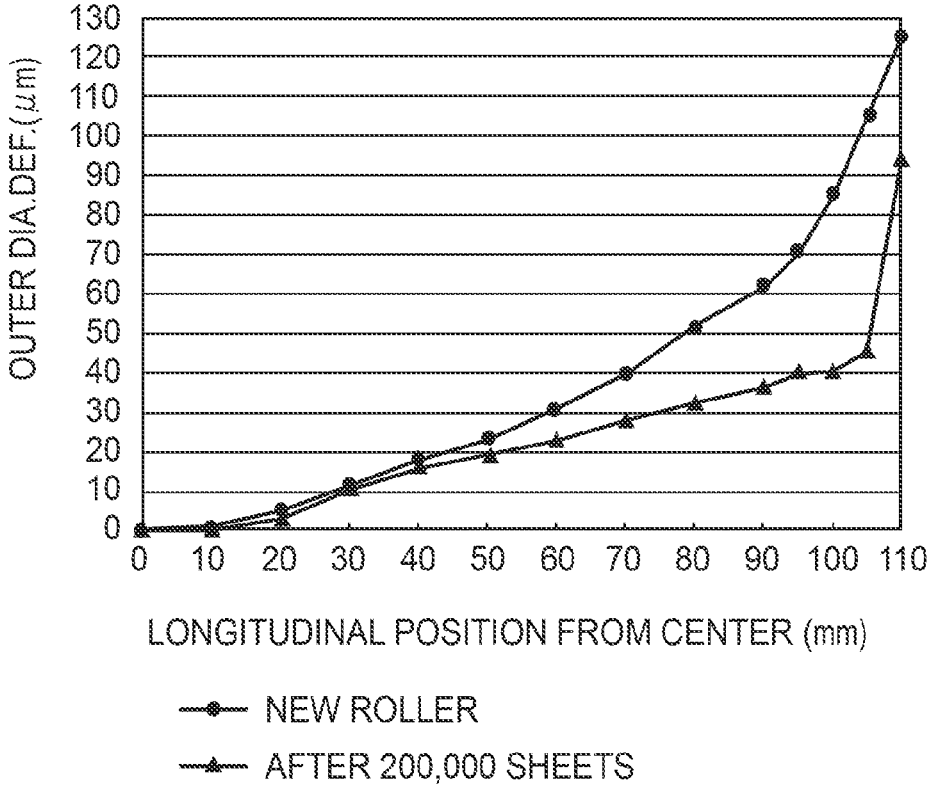

FIG. 16 is a graph for illustrating a longitudinal outer diameter shape of a pressing roller of a conventional fixing apparatus.

DESCRIPTION OF THE PREFERRED EMBODIMENTS

Embodiment 1

A first exemplary embodiment is described.

(1) Image Forming Apparatus

Figure 1:
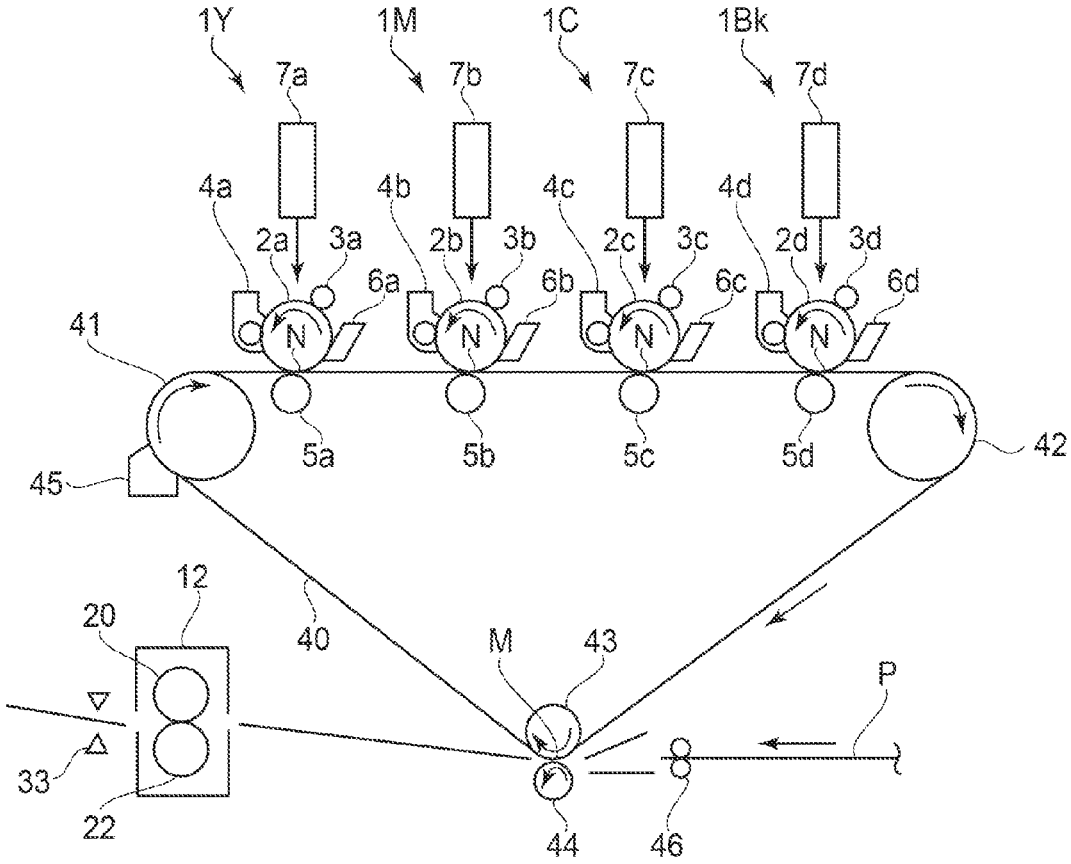
FIG. 1 is a schematic illustration of an image forming apparatus in Embodiment 1.

FIG. 1 is a schematic illustration of an image forming apparatus in this embodiment. The image forming apparatus is of an electrophotographic type and is a tandem type full-color printer. In this image forming apparatus, a recording material is conveyed on the basis of center (line) conveyance such that a longitudinal center of a recording material conveyance path and a longitudinal center of the recording material with respect to a recording material conveyance direction are aligned with each other with respect to a direction perpendicular to the recording material conveyance direction.

The image forming apparatus in this embodiment includes four image forming portions (image forming units) which are provided in a line with certain intervals. The four image forming portions are an image forming portion 1Y for forming a yellow image, an image forming portion 1M for forming a magenta image, an image forming portion 1C for forming a cyan image and an image forming portion 1Bk for forming a black image.

The respective image forming portions 1Y, 1M, 1C and 1Bk include photosensitive drums 2*a*, 2*b*, 2*c* and 2*d*, respectively. Around the photosensitive drums 2*a*, 2*b*, 2*c* and 2*d*, members including charging rollers 3*a*, 3*b*, 3*c* and 3*d*, developing devices 4*a*, 4*b*, 4*c* and 4*d*, transfer rollers 5*a*, 5*b*, 5*c* and 5*d* and cleaning devices 6*a*, 6*b*, 6*c* and 6*d* are provided.

Above the charging rollers 3*a*, 3*b*, 3*c* and 3*d* and the developing devices 4*a*, 4*b*, 4*c* and 4*d*, exposure devices 7*a*, 7*b*, 7*c* and 7*d* are provided. In the developing devices 4*a*, 4*b*, 4*c* and 4*d*, a yellow toner, a magenta toner, a cyan toner and a black toner are accommodated, respectively.

Outer peripheral surfaces of the photosensitive drums 2*a*, 2*b*, 2*c*, and 2*d* of the image forming portions 1Y, 1M, 1C and 1K and an outer peripheral surface of an endless intermediary transfer belt 40 as an intermediary transfer member are contacted to each other to form primary transfer portions N.

The intermediary transfer belt 40 is stretched by a driving roller 41, a supporting roller 42 and a secondary transfer opposite roller 43 and is rotated (moved) in an arrow direction by rotation of the driving roller 41. The transfer rollers 5*a*, 5*b*, 5*c* and 5*d* for primary transfer are disposed opposed to the photosensitive drums 2*a*, 2*b*, 2*c* and 2*d*, respectively, via the intermediary transfer belt 40 in the respective primary transfer portions (nips) N. A secondary transfer roller 44 is provided opposed to the secondary transfer opposite roller 43 via the intermediary transfer belt 40, and the outer peripheral surface of the secondary transfer roller 44 and the surface of the intermediary transfer belt 40 contact each other to form a secondary transfer portion M.

Outside the intermediary transfer belt 40 in the neighborhood of the driving roller 41, a belt cleaning device 45 for removing and collecting a transfer residual toner remaining on the surface of the intermediary transfer belt 40 is provided. In a downstream side of the secondary transfer portion M with respect to a conveyance direction of a recording material P, a fixing apparatus (device) 12 is provided.

In the image forming apparatus in this embodiment, when receives an image formation start signal outputted from an external device (not shown) such as a host computer, a motor (not shown) is rotationally driven to rotate the photosensitive drums 2*a*, 2*b*, 2*c* and 2*d* in arrow directions at a predetermined peripheral speed (process speed). The outer peripheral surfaces of the photosensitive drums are uniformly charged to predetermined polarity and potential by the charging rollers 3*a*, 3*b*, 3*c* and 3*d*. In this embodiment, the surfaces of the photosensitive drums 2*a*, 2*b*, 2*c* and 2*d* are charged to the negative polarity.

The exposure devices 7*a*, 7*b*, 7*c* and 7*d* convert color-separated image signals inputted from the external device into light signals by a laser output portion (not shown). The charged surfaces of the photosensitive drums 2*a*, 2*b*, 2*c* and 2*d* are scanning-exposed to laser light which is the converted light signals, so that electrostatic latent images are formed thereon, respectively.

Onto the surface of the photosensitive drum 2*a* on which the electrostatic latent image is formed, the yellow toner is electrostatically attracted depending on the charge potential of the surface of the photosensitive drum 2*a* by the developing device 4*a* to which a developing bias of the same polarity as the charge polarity (negative) of the photosensitive drum 2*a* is applied. By this electrostatic attraction, the electrostatic latent image is visualized by the yellow toner to form a yellow toner image. This yellow toner image is primary-transferred at the primary transfer portion N onto the surface of the rotating intermediary transfer belt 40 by the transfer roller 5*a* to which a primary transfer bias (of a (positive) polarity opposite to the toner charge polarity) is applied.

The intermediary transfer belt 40 on which the yellow toner image is transferred is rotated toward the image forming portion 1M. Then, also at the image forming portion 1M, similarly, a magenta toner image is formed on the surface of the photosensitive drum 2*b* and then is superposedly transferred onto the yellow toner image on the surface of the intermediary transfer belt 40 in the primary transfer portion N.

In a similar manner, on the yellow and magenta toner images superposedly transferred on the intermediary transfer belt 40, cyan and black toner images formed on the surfaces of the photosensitive drums of the image forming portions 1C and 1Bk are successively superposed at the primary transfer portions N. As a result, a full-color toner image consisting of the four color toner images is formed on the surface of the intermediary transfer belt 40.

Then, the recording material P is conveyed to the secondary transfer portion M by registration rollers 46 in synchronism with timing when a leading end of the full-color toner image on the intermediary transfer belt 40 reaches the secondary transfer portion M. Onto the recording material P, the full-color toner image is secondary-transferred collectively by the secondary transfer belt 44 to which a secondary transfer bias (of a (positive) polarity opposite to the toner charge polarity) is applied.

The recording material P for carrying the full-color toner image is conveyed to the fixing apparatus (fixing device) 12. Then, the unfixed full-color toner image is heat-fixed on the recording material P while being nip-conveyed in a fixing nip Nt formed between a fixing film 20 and a pressing roller 22 which constitute the fixing apparatus 12. The recording material P coming out of the fixing nip Nt is discharged onto a discharge tray (not shown) by a discharging roller (not shown).

During the primary transfer described above, primary transfer residual toners remaining on the photosensitive drums 2*a*, 2*b*, 2*c* and 2*d* are removed and collected by the drum cleaning devices 6*a*, 6*b*, 6*c* and 6*d*. Further, a secondary transfer residual toner remaining on the surface of the intermediary transfer belt 40 after the secondary transfer is removed and collected by the belt cleaning device 45.

In the following description, with respect to the fixing apparatus and members constituting the fixing apparatus, a longitudinal direction refers to a direction perpendicular to a recording material conveyance direction. A widthwise direction refers to a direction parallel to the recording material conveyance direction. A length refers to a dimension with respect to the longitudinal direction. A width refers to a dimension with respect to the widthwise direction. With respect to the recording material, a width direction refers to a direction perpendicular to the recording material conveyance direction. A length refers to a dimension with respect to the width direction.

In FIG. 2, (a) is a schematic sectional view of the fixing apparatus and (b) is perspective view of the fixing apparatus. FIG. 3 includes a schematic illustration of a heater and a block diagram of an energization control system of the heater. The fixing apparatus 12 in this embodiment is of a fixing film heating type and a pressing roller-driving type (tension-less type).

The fixing apparatus 12 includes the fixing film 20 as a cylindrical rotatable fixing member and a ceramic heater 16 as a heating member for heating the fixing film 20 in contact with an inner surface of the fixing film 20. Further, the fixing apparatus 20 includes a heater holder 17 as a supporting member for supporting the heater 16 at the inside of the fixing film 20 and includes the pressing roller 22 as a rotatable pressing member for forming the fixing nip Nt between itself and the fixing film 20 contacted to the heater 16. Each of the fixing film 20, the heater 16, the heater holder 17 and the pressing roller 22 is an elongated member extending in the longitudinal direction.

The heater 16 in this embodiment is of a rear (back) surface heat generation type. In (a) of FIG. 2 and FIG. 3, an elongated substrate 100 which has high-heat transfer property and which is formed of a ceramic material such as aluminum nitride. The substrate 100 is formed with a width broader than the width of the fixing nip Nt.

On the back surface of the substrate 100 close to the fixing film 20, along the longitudinal direction of the substrate 100, a first energization heat generating resistor layer 101 and a second energization heat generating resistor layer 102 which are formed of an electroconductive material such as silver/palladium (Ag/Pd) by screen printing or the like.

Further, at a longitudinal end portion of the substrate 100 in the backside, an electrode portion 104 for energizing the first energization heat generating resistor 101 and an electrode portion 105 for energizing the second energization heat generating resistor layer 102 are formed by the screen printing or the like.

Further, at the other longitudinal end portion of the substrate 100 in the back side, a common electrode 103 for energizing the first energization heat generating resistor layer 101 and the second energization heat generating resistor layer 102 is formed by the screen printing or the like. Further, on the back surface of the substrate 100, an insulating protective layer 106 is formed of glass or the like so as to cover the first and second energization heat generating resistor layers 101 and 102.

To the first energization heat generating resistor layer 101, a first triac 31 as a first electric power supplying means is electrically connected via the common electrode portion 103 and the electrode portion 104. To the second energization heat generating resistor layer 102, a second triac 32 as a second electric power supplying means is electrically connected via the common electrode portion 103 and the electrode portion 105. Further, to the first triac 31 and the second triac 32, an energization controller 30 as an energization control means is electrically connected. The energization controller 30 is constituted by CPU and memories such as ROM and RAM.

In FIG. 3, each of the first and second energization heat generating resistor layers 101 and 102 is formed in a length of 223 mm. Of these layers, the first energization heat generating resistor layer 101 generates heat by supplying electric power (energy) between the common electrode portion 103 and the electrode portion 104 from a commercial power source G via the first triac 31. The second energization heat generating resistor layer 102 generates heat by supplying the electric power between the common electrode portion 103 and the electrode portion 105 from the commercial power source G via the second triac 32.

The second energization heat generating resistor layer 102 is formed so as to have a non-uniform resistance value distribution with respect to its longitudinal direction. That is, the second energization heat generating resistor layer 102 is formed so that a resistance value per unit length of both end portions 102*e* thereof with respect to the longitudinal direction (hereinafter referred to as longitudinal end portions) is higher than that at a central portion 102*c* thereof with respect to the longitudinal direction (hereinafter referred to as a longitudinal central portion) between the longitudinal end portions.

In this embodiment, as shown in FIG. 3, the second energization heat generating resistor layer 102 of 223 mm in length is more narrowed in width than the longitudinal central portion 102*c* in a region of 20 mm at each of the longitudinal end portions 102*e*. As a result, only in the region of 20 mm at each of the longitudinal end portions 102*e*, compared with the longitudinal central portion 102*c*, the resistance value per unit length is set at a high value. In this embodiment, when the resistance value per unit length of the longitudinal central portion 102*c* is 100%, the resistance value per unit length of the longitudinal end portion 102*e* is 120%.

That is, the second energization heat generating resistor layer 102 is constituted so that an amount of heat generation per unit length thereof is larger at the longitudinal end portion 102*e* than that at the longitudinal central portion 102*c*. Different from the second energization heat generating resistor layer 102, the first energization heat generating resistor has a resistance value distribution per unit length such that the resistance value is uniform over the longitudinal direction. That is, the first energization heat generating resistor layer 101 is constituted so that the amount of heat generation per unit length is the same with respect to the longitudinal direction.

Further, in this embodiment, the first and second energization heat generating resistor layers 101 and 102 are formed so as to have the substantially same resistance value over the entire longitudinal direction. That is, the resistance value between the common electrode portion 103 and the electrode portion 104 for the first energization heat generating resistor layer 101 and the resistance value between the common electrode portion 103 and the electrode portion 104 for the second energization heat generating resistor layer 102 are the same. As a result, in the case where the energization to the first and second energization heat generating resistor layers 102 and 102 is effected with the same duty ratio, the amount of heat generation of each of the first and second energization heat generating resistor layers 102 and 102 over the entire longitudinal direction is the same.

The fixing film 20 is constituted by forming an elastic layer (not shown) on an outer peripheral surface of a base layer (not shown) having an endless belt-like shape. The heater holder 17 is formed of a high-resistant liquid polymer resin in a substantially semi-circular trough-like shape in cross section. The heater holder 17 is provided with a groove, along its longitudinal direction, at a widthwise central portion of the outer peripheral semi-circular surface contacted to the inner (peripheral) surface of the fixing film 20, so that the heater 16 is engaged with the groove of the heater holder 17 and is supported by the heater holder 17. The fixing film 20 is externally engaged loosely with the heater holder 17, on which the heater 16 is supported, at the outer peripheral surface of the heater holder 17.

The outer peripheral semi-circular surface of the heater holder 17 has the function of guiding the inner surface of the fixing film 20 in a rotation operation state of the fixing film 20.

The pressing roller 22 is constituted by forming an elastic layer 22*b* of a silicone rubber through ejection molding on the outer peripheral surface of a metal core 22*a* of stainless steel and then by coating a FPA resin tube as a parting layer 22*c* on the outer peripheral surface of the elastic layer 22*b*. The thickness of the elastic layer 22*b* is about 3.5 mm. The thickness of the parting layer is 70 μm. The length of each of the elastic layer 22*b* and the parting layer 22*c* of the pressing roller 22 is 231 mm. That is, each of the elastic layer 22*b* and the parting layer 22*c* has a length of 115.5 mm from its longitudinal center to its both longitudinal ends.

The pressing roller 22 is disposed in parallel to the fixing film 20. Further, the core metal 22*a* is non-rotatably supported at its longitudinal end portions by front and rear side plates (not shown) of a fixing apparatus frame 24 via bearings (not shown). Further, on the front and rear side plates of the frame 24, both end portions of the heater holder 17 protruded outward from the longitudinal both ends of the fixing film 20 are supported.

Further, the both end portions of the fixing film 20 are urged by an urging mechanism (not shown) in a radial direction perpendicular to an axial direction of the pressing roller 22 under application of pressure of 122.5 N (12.5 kgf) in each side, i.e., 256 N (25 kgf) in total. By this pressure, the heater 16 is urged against the fixing film 20 toward the outer peripheral surface of the pressing roller 22, so that the elastic layer 22*b* is elastically deformed in a predetermined amount with respect to the radial direction.

As a result, the fixing nip Nt with a predetermined width necessary to heat-fix the toner image is formed between the outer peripheral surface of the fixing film 20 and the surface of the pressing roller 22. That is, the pressing roller 22 and the fixing film 20 contacted to the heater 16 from the fixing nip Nt.

In (b) of FIG. 2, a main thermistor 18 as a temperature detecting member and two sub-thermistors 19*a* and 19*b* as the temperature detecting member are provided. In (a) of FIG. 19, the two sub-thermistors 19*a* and 19*b* are on the same line and therefore only one sub-thermistor 19*a* (19*b*) is illustrated.

The main thermistor 18 is disposed so as to be elastically contacted to the inner surface of the fixing film 20 to detect the temperature of the inner surface of the fixing film 20. The main thermistor 18 is prepared by bonding a thermistor element to an end of an arm 25 of stainless steel fixedly supported by the heater holder 17.

The thus-constituted in thermistor 18 is kept in a state in which the thermistor element is always contacted to the inner surface of the fixing film 20, even when motion of the inner surface of the fixing film 20 is unstable, by elastical swing of the arm 25. The sub-thermistors 19*a* and 19*b* are disposed on the substrate 100 of the heater so as to contact the surface of the heater holder 17, thus detecting the temperature of the heater 16.

The main thermistor 18 is disposed in the neighborhood of the longitudinal center of the fixing film 20. The sub-thermistors 19*a* and 19*b* are disposed equidistantly from the longitudinal center of the heater 16 at the both end portions (each 99 mm from the longitudinal center). In other words, the sub-thermistors 19*a* and 19*b* are disposed at positions equidistantly spaced from the longitudinal center of the first and second energization heat generating resistor layers 101 and 102 of the heater 16.

In (a) of FIG. 2, an entrance guide 23 and a fixing discharging roller 26 are assembled with the fixing apparatus frame 24. The entrance guide 23 is used for guiding the recording material P, passing through the secondary transfer nip M, to the fixing nip Nt. The entrance guide 23 is formed of a polyphenylene sulfide (PPS) resin. The fixing discharging roller 26 is used for conveying the recording material, coming out of the fixing nip Nt, to the discharging roller (not shown).

(3) Heat-Fixing Operation of Fixing Apparatus 12

In the fixing apparatus 12 in this embodiment, the pressing roller 22 is rotated in an arrow direction at a predetermined peripheral speed (process speed) by the rotational drive of the above-described motor. A rotational force of the pressing roller 22 is transmitted to the surface of the fixing film in the fixing nip Nt by a frictional force between the surface of the pressing roller 22 and the surface of the fixing film 20. As a result, the fixing film 20 is rotated in an arrow direction by the rotation of the pressing roller 22 while contacting the surface of the insulating protective layer 106 of the heater 16 at its inner surface. Onto the inner surface of the fixing film 20, grease is applied, so that a sliding property belt the inner surface of the fixing film 20 and the outer peripheral semicircular surface of the heater holder 17 and between the inner surface of the fixing film 20 and the surface of the insulating protective layer 106 is ensured.

The energization controller 30 turns on each of the first triac 31 and the second triac 32 when it receives the image formation start signal. The first triac 31 and the second triac 32 starts energization (electric power supply) to the corresponding energization heat generating resistor layers 101 and 102, respectively, with the same duty ratio (100%). As a result, the first and second energization heat generating resistor layers 101 and 102 generate heat to quickly increase the heater 16 in temperature. Then, by the heat from the heater 16, the fixing film 20 is heated in the order of the base layer and the elastic layer.

Further, the energization controller 30 obtains a detection temperature (temperature information) from the main thermistor 18. On the basis of this detection temperature, the duty ratio, a wave number and the like of voltages applied from the first triac 31 and the second triac 32 to the corresponding energization heat generating resistor layers 101 and 102, respectively are properly controlled, so that the temperature of the fixing film 20 is kept at a predetermined fixing temperature (target temperature).

In a state in which the pressing roller 22 is rotated and the heater 16 is temperature-controlled at the predetermined fixing temperature, the recording material P on which the unfixed toner image t is carried is guided by the entrance guide 23 with a toner image-formed surface upward, thus being passed through (guide into) the fixing nip Nt.

This recording material P is intimately contacted to the surface of the fixing film 20 in the fixing nip Nt at its toner image-formed surface and is nip-conveyed in the fixing nip Nt together with the fixing film 20. In this nip-conveying process, the heat of the heater 16 is applied to the recording material P via the fixing film 20. As a result, the unfixed toner image t on the recording material P is melted under heat and pressure application to be heat-fixed on the recording material. The recording material P coming out of the fixing nip Nt is curvature-separated from the surface of the fixing film 20 and then is discharged by the fixing discharging roller 26.

(4) Heat Generation Distribution of Second Energization Heat Generating Resistor Layer 12 of Heater 16

As described above, in the case where the energization to the first and second energization heat generating resistor layers 101 and 102 is effected with the same duty ratio, the amount of heat generation of each of the first and second energization heat generating resistor layers 101 and 102 over the entire longitudinal direction is the same.

However, the second energization heat generating resistor layer 102 has the large amount of heat generation at the longitudinal end portions and therefore the heat generation distribution per unit length of the heater 16 is such that the amount of heat generation at the longitudinal end portions 102*e* is larger than that at the longitudinal central portion.

As a result, by fluctuating the duty ratio for the first energization heat generating resistor layer 101 and the duty ratio for the second energization heat generating resistor layer 102, it is possible to change the heat generation distribution of the heater 16 at the longitudinal end portions. That is, by making the duty ratio for the second energization heat generating resistor layer 102 larger than the duty ratio for the first energization heat generating resistor 101, the amount of heat generation of the heater 16 is increased at the longitudinal end portions.

(5) Reverse Crown Shape of Pressing Roller 22

Here, the reverse crown shape of the pressing roller 22 in this embodiment will be described. FIG. 4 shows the longitudinal outer diameter shape of the pressing roller 22 in a room temperature state (25° C.) in this embodiment. In FIG. 4, the ordinate represents an outer diameter difference of the pressing roller 22 on the basis of the outer diameter of about 25 mm at the longitudinal center of the pressing roller 22. The abscissa represents a distance from the longitudinal center with respect to the longitudinal direction of the pressing roller 22. In FIG. 4, the pressing roller 22 is formed in a symmetrical shape with respect to the longitudinal direction and therefore only the outer diameter shape from the longitudinal center to the longitudinal end in one side is shown.

The reverse crown shape of the pressing roller 22 is, as shown in FIG. 4, such that a region where the outer diameter is increased from the longitudinal center toward the longitudinal end portion is formed. In this embodiment, the outer diameter of the pressing roller 22 at the position spaced from the longitudinal center toward the longitudinal end portion by 105 mm is larger than the outer diameter at the longitudinal center by about 105 μm.

Further, an amount obtained by subtracting the longitudinal center outer diameter from the outer diameter of the pressing roller 22 at a position spaced from the longitudinal center by a predetermined distance with respect to the longitudinal direction is referred to as a reverse crown amount. In this embodiment, the reverse crown amount is 105 μm.

(6) Outer Diameter Change by Thermal Expansion of Pressing Roller 22

FIG. 5 shows a measurement result of the outer diameter of the pressing roller 22 in the case where the pressing roller 22 is heated.

In FIG. 5, the ordinate represents the outer diameter, and the abscissa represents the temperature of the pressing roller 22. The outer diameter of the pressing roller 22 was measured at the longitudinal center and a position spaced from the longitudinal center by 105 mm with respect to the longitudinal direction (position which is 3 mm inside an end of LTR-sized paper). As shown in FIG. 5, the outer diameter of the pressing roller 22 at each of the longitudinal center (broken line) and the longitudinal end portion (solid line) is increased by the thermal expansion of the elastic layer 22*b* with an increasing temperature of the pressing roller 22.

The reason why there is a difference between the longitudinal center outer diameter and the longitudinal end portion outer diameter of the pressing roller 22 in the room temperature state is that the pressing roller 22 originally has the reverse crown shape. From the measurement result of the outer diameter change due to the thermal expansion shown in FIG. 5, it is understood that the pressing roller 22 is thermally expanded at a rate of 6 μm/° C. at both of the longitudinal center portion and the longitudinal end portion.

(7) Temperature Distribution and Outer Diameter Shape of Pressing Roller 22 with Respect to Longitudinal Direction In this embodiment, depending on the number of sheets of the recording material P passed continuously through the fixing nip Nt, the energization ratio between the first and second energization heat generating resistor layers 101 and 102 is changed as shown in Table 1.

TABLE 1

| (Sheets) | I.B.E.*$_1$ | 1-50 | 51-100 | 101- |
|---|---|---|---|---|
| E.R.*$_2$ | 100% | 100% | 90% | 80% |

*$_1$"I.B.E." represents until the time immediately before entering of the recording material into the fixing nip.
*$_2$"E.R." represents the energization ratio.

In Table 1, the energization ratio of the energization to the second energization heat generating resistor layer 102 to the energization to the first energization heat generating resistor layer 101 for which the resistance value per unit length is uniform over the longitudinal direction of the heater 16 is shown.

For that reason, in Table 1, in the case where the energization ratio is 100%, "100%" does not mean that both of the first and second energization heat generating resistor layers 101 and 102 are energized with the duty ratio of 100% but means that in the case where the first energization heat generating resistor layer 101 is energized with a predetermined duty ratio, the second energization heat generating resistor layer 102 is energized with the same duty ratio.

Further, in Table 1, in the case where the energization ratio is 80%, "80%" means that the second energization heat generating resistor layer 102 is energized with the duty ratio which is 0.8 time that for the first energization heat generating resistor layer 101. That is, the energization ratio is the ratio of the energization to the second energization heat generating resistor layer 102 to the energization to the first energization heat generating resistor layer 101.

In Table 1, the energization ratio between the energization heat generating resistor layers in the case where the LTR-sized paper (width: 215 mm) as a maximum-width recording material capable of being passed through the fixing apparatus 12 mounted in the image forming apparatus in this embodiment is shown.

Further, in this embodiment, a conveyance speed of the recording material P by the fixing apparatus 12 is 240 mm/sec, and in the case where the sheets of the recording material P are continuously passed through the fixing nip Nt, the number of sheets per unit time of the recording material P passed through the fixing nip Nt is 40 sheets/min.

Under the above-described condition, by using a pressing roller A which is brand new and unused and a pressing roller B after subjected to the sheet passing on about 200,000 sheets, comparative experiments were conducted.

The comparative experiments were conducted under a condition in which the creases of the recording material were liable to be caused. As the recording material used in the comparative experiments, plain paper of 75 g/m$_2$ in basis weight which was left standing for 48 hours or more in a high-temperature and high-humidity environment to sufficiently take up moisture was used. In the following description, the creases generated in this plain paper as the recording material P is referred to as paper crease.

In the following, first, three comparative experiments (Comparative Experiments 1 to 3) will be described and then in view of results of these comparative experiments, the fixing apparatus 12 in this embodiment will be described.

Comparative Experiment 1

In each of a fixing apparatus using the pressing roller A and a fixing apparatus using the pressing roller B, energization control of the heater 16 was effected with the energization ratio shown in Table 1 and the sheets of the recording material were passed through the fixing nip of the associated fixing apparatus. The above two fixing apparatuses have the same constitution and specifications except for the pressing roller. The sheet passing of the recording material through the fixing nip was performed from a state in which the heater of the fixing apparatus was sufficiently cooled to the room temperature state (25° C.).

As a result, in the case where the pressing roller A was used, the paper crease was not generated. On the other hand, in the case where the pressing roller B was used, the paper crease was generated on the first sheet but was not generated on the second sheet or later.

This experimental result will be considered. FIG. 6 shows a longitudinal temperature distribution of the pressing roller A and the pressing roller B immediately before the first sheet of the recording material enters the fixing nip during the sheet passing of the recording material. Here, the temperature distribution of the pressing roller A and the pressing roller B is bilaterally (left-right) symmetrical with respect to the longitudinal direction and therefore in FIG. 6, only the longitudinal temperature distribution from the longitudinal center to the longitudinal end in one side is shown.

In FIG. 6, the ordinate represents the pressing roller temperature, and the abscissa represents the distance from the longitudinal center toward the longitudinal end of the pressing roller.

The longitudinal temperature distribution of the pressing roller A and the pressing roller B is not affected by the pressing roller outer diameter shape and therefore there is no difference in longitudinal temperature distribution between the pressing roller A and the pressing roller B.

From FIG. 6, it is understood that the longitudinal end portion (region in which the distance from the longitudinal center ranges from 90 mm to 110 mm) of the pressing roller is low in temperature compared with the longitudinal central portion (region in which the distance from the longitudinal center ranges from 0 mm to 90 mm) of the pressing roller.

This is because in the case where the heater 16 of the pressing roller is raised in temperature from the cooled state (room temperature state), the heat of the heater is dissipated at the longitudinal end portion and therefore the longitudinal end portion temperature of the pressing roller is not readily increased. The longitudinal outer diameter shape of the pressing roller in this case is, since the elastic layer of the pressing roller is not readily thermally expanded at the longitudinal end portion than at the longitudinal central portion.

A result of longitudinal outer diameter shapes, of the pressing roller A and the pressing roller B in this experiment, calculated from the result of FIG. 5 and the temperature distribution of FIG. 6 is shown in FIG. 7. FIG. 7 shows the longitudinal outer diameter shapes of the pressing rollers A and B immediately before the recording material enters the fixing nip.

Further, FIG. 7 also shows the longitudinal outer diameter shapes of the pressing rollers A and B in the room temperature state. Further, in FIG. 7, similarly as in the preceding figures, the outer diameter shape from the longitudinal center to the longitudinal end of each of the pressing rollers A and B is shown. In FIG. 7, the ordinate represents the outer diameter difference on the basis of the outer diameter of the pressing roller at the longitudinal center, and the abscissa represents the distance from the longitudinal center of the pressing roller with respect to the longitudinal direction.

In FIG. 7, at the longitudinal central portion (region of 0-90 mm from the longitudinal center), the temperature distribution is the same and therefore there is substantially no difference in outer diameter shape between the pressing rollers A and B even in the room temperature ST and in the heated state.

On the other hand, at the longitudinal end portion (region of 90-110 mm from the longitudinal center), the result is as follows.

In the case of the pressing roller A, even when the longitudinal temperature distribution immediately before the recording material enters the fixing nip is lowered at the longitudinal end portion, an original reverse crown amount in the room temperature state is large and therefore the reverse crown shape is maintained.

On the other hand, with respect to the pressing roller B, the outer diameter difference between the longitudinal central portion and the longitudinal end portion at the time immediately before the recording material enters the fixing nip is smaller than that at the time of the brand-new state in the room temperature state. In addition, with respect to the pressing roller B, in the heated state at the time immediately before the recording material P enters the fixing nip, the longitudinal end portion temperature is lower than the longitudinal central portion temperature. As a result, the outer diameter of the pressing roller B at the longitudinal end portion is smaller than the outer diameter in a region closer to the longitudinal center than the longitudinal end portion.

Specifically, with respect to the pressing roller B, in the room temperature state, the outer diameter at the position spaced from the longitudinal center by 90 mm with respect to the longitudinal direction is maximum and is larger than that the longitudinal center by about 40 μm.

However, in the heated state at the time immediately before the recording material enters the fixing nip, the outer diameter at the position spaced from the contact by 105 mm is decreased and is merely larger than that at the longitudinal center by about 20 μm. The position spaced from the longitudinal center by 105 mm with respect to the longitudinal direction of the pressing roller is the neighborhood of a side edge of the LTR-side recording material in the case where the LTR-sized recording material is passed through the fixing nip.

When the recording material in the state immediately before the recording material enters the fixing nip as shown in FIG. 7 enters the fixing nip formed by the pressing roller B, a region in which the conveyance speed of the recording material becomes slow at the longitudinal end portion with respect to the longitudinal direction is created and in the region, the paper crease is liable to occur. This occurrence of the paper crease is liable to be caused on the first sheet and is not readily caused on the second sheet and later. On the other hand, in the case of the pressing roller A, the region in which the conveyance speed of the recording material becomes slow at the longitudinal end portion with respect to the longitudinal direction is not created and therefore the paper crease does not occur.

Here, the reason why the paper crease is not readily caused on the second sheet and later even in the case where the pressing roller B is used will be described. Until immediately before the recording material enters the fixing nip, there is no recording material in the fixing nip.

However, after the recording material enters the fixing nip, the heat of the pressing roller B is taken by the recording material and therefore in a recording material conveyance region with respect to the longitudinal direction, i.e., at the longitudinal central portion, the temperature is lowered. Therefore, after the heat of the pressing roller B is taken by the first recording material and immediately before the second recording material enters the fixing nip, the longitudinal temperature distribution of the pressing roller B is such that the longitudinal end portion temperature is higher than the longitudinal central portion temperature.

For that reason, by the thermal expansion, the reverse crown amount of the pressing roller B becomes large. For this reason, in the case where the sheets of the recording material are continuously passed through the fixing nip, the paper crease is liable to be caused on the first sheet but is not readily caused on the second sheet and the later.

That is, in order to suppress the occurrence of the paper crease, the reverse crown amount of the pressing roller may only be required to be a proper amount until the time immediately before the recording material enters the fixing nip.

Comparative Experiment 2

Next, the following experiment was conducted by using the two fixing apparatuses used in Comparative Experiment 1. The sheet passing of the recording material through the fixing nip was effected in each of the fixing apparatuses in a state in which the energization ratio of the energization to the second energization heat generating resistor layer 102 to the energization to the first energization heat generating resistor layer 101 until the recording material entered the fixing nip as shown in Table 1 was changed to 130%. Other conditions are the same as those in Comparative Experiment 1. In this experiment, the paper crease was not generated both in the case of using the pressing roller A and in the case of using the pressing roller B.

This experimental result will be considered. FIG. 8 shows a longitudinal temperature distribution of the pressing roller A and the pressing roller B in the heated state at the time immediately before of the recording material enters the fixing nip. In FIG. 8, the ordinate represents the temperature of each of the pressing rollers A and B, and the abscissa represents the distance from the longitudinal center toward the longitudinal end of each of the pressing rollers A and B. With respect to the longitudinal central portion temperature distribution of the pressing rollers A and B, there is no difference between the pressing roller A and the pressing roller B, similarly as in Comparative Experiment 1 (FIG. 6).

On the other hand, the longitudinal end portion temperature distribution of the pressing rollers A and B is such that the longitudinal end portion temperature is higher than the longitudinal central portion temperature. This is because the energization ratio of the energization to the second energization heat generating resistor layer 102 to the energization to the first energization heat generating resistor layer 101 is increased and therefore the amount of heat generation of the heater 16 is increased at the longitudinal end portion.

Similarly as in Comparative Experiment 1, a result of longitudinal outer diameter shapes, of the pressing roller A and the pressing roller B in this experiment, calculated from the result of FIG. 5 and the temperature distribution of FIG. 8 is shown in FIG. 9. Similarly as in Comparative Experiment 1 (FIG. 7), in FIG. 9, the outer diameter shape from the longitudinal center to the longitudinal end of each of the pressing rollers A and B is shown. In FIG. 9, the ordinate represents the outer diameter difference on the basis of the outer diameter of the pressing roller at the longitudinal center, and the abscissa represents the distance from the longitudinal center of the pressing roller with respect to the longitudinal direction.

As shown in FIG. 8, the longitudinal end portion temperature of the pressing rollers A and B is higher than the longitudinal central portion temperature so that a degree of the thermal expansion at the longitudinal end portion of the pressing rollers A and B is larger than that at the longitudinal central portion. For that reason, as shown in FIG. 9, also with respect to the pressing roller B, at the time immediately before the recording material enters the fixing nip, the reverse crown amount is increased at the position closer to the longitudinal end of the pressing roller B. Therefore, in the case where the recording material in the state immediately before the recording material enters the fixing nip enters the fixing nip, the conveyance speed of the recording material becomes fast with the position closer to the longitudinal end with respect to the longitudinal direction, so that the paper crease is not generated.

In the case of the pressing roller A, compared with the case of the pressing roller B, the reverse crown amount at the longitudinal end portion is large, so that the paper crease is not generated.

Comparative Experiment 3

Next, by using the two fixing apparatuses used in Comparative Experiment 1, the energization control was effected with the same energization ratio as that in Comparative Experiment 2 and the sheet passing of the recording material though the fixing nip was performed from a state in which each of the fixing apparatuses was sufficiently warmed.

Here, the state in which each of the fixing apparatuses was sufficiently warmed refers to a state immediately after 100 sheets of the LTR-sized recording material are continuously passed through the fixing nip in each of the fixing apparatuses. In this experiment, in the case of using the pressing roller A, a friction image with the fixing film due to an excessively high conveyance speed of the recording material and an initial stage of the sheet passing on several sheets was generated. In the case of using the pressing roller B, the friction image was not generated.

This experimental result will be considered. FIG. 10 shows a longitudinal temperature distribution of the pressing roller A and the pressing roller B at the time immediately before of the recording material enters the fixing nip similarly as in Comparative Experiments 1 and 2. In FIG. 10, the ordinate represents the temperature of each of the pressing rollers A and B, and the abscissa represents the distance from the longitudinal center toward the longitudinal end of each of the pressing rollers A and B. With respect to the longitudinal temperature distribution of the pressing rollers A and B, there is no difference between the pressing roller A and the pressing roller B, similarly as in Comparative Experiment 2 (FIG. 8).

Further, a result of longitudinal outer diameter shapes, of the pressing roller A and the pressing roller B in this experiment, calculated from the result of FIG. 5 and the temperature distribution of FIG. 10 is shown in FIG. 11. As is understood from FIG. 10, the pressing rollers A and B are originally warmed and the heat dissipation from the longitudinal end portion is also substantially suppressed. From this state, rising of the heater for the fixing apparatus is effected and therefore the temperature distribution of each of the pressing rollers A and B at the time immediately before the recording material enters the fixing nip is such that the longitudinal end portion temperature is higher than the longitudinal central portion temperature (FIG. 11).

In this experiment, in the case of the pressing roller A, in addition to the reverse crown shape which is originally large in reverse crown amount, the longitudinal end portion temperature is larger than the longitudinal central portion temperature and therefore a degree of the thermal expansion at the longitudinal end portion is also large. As a result, the longitudinal end portion outer diameter of the pressing roller A becomes large more than necessary compared with the longitudinal control outer diameter of the pressing roller A.

As shown in FIG. 11, specifically, in the case of the pressing roller A, in the heated state immediately before the recording material enters the fixing nip, the outer diameter at the position spaced from the longitudinal center by 105 mm with respect to the longitudinal direction is larger than the outer diameter of the longitudinal center by 160 μm or more. In other words, the outer diameter difference between the longitudinal center and the position of 105 mm from the longitudinal center with respect to the longitudinal direction of the pressing roller A is 160 μm or more. In this state, when the recording material entered the fixing nip, in some cases, the recording material conveyance speed at the longitudinal end portion relative to the longitudinal central portion of the pressing roller A was excessively high to cause the friction image.

Here, as described above, the longitudinal central portion of the pressing roller refers to the region in which the distance from the longitudinal center ranges from 0 mm to 90 mm, and the longitudinal end portion of the pressing roller refers to the region in which the distance from the longitudinal center ranges from 90 mm to 110 mm.

In the case of the pressing roller B, the original reverse crown amount at the longitudinal end portion is small and therefore even when the pressing roller B is thermally expanded immediately before the recording material enters the fixing nip, the outer diameter at the longitudinal end portion is not so increased compared with the case of the pressing roller A.

In the case of the pressing roller B, at the time immediately before the recording material enters the fixing nip, the outer diameter at the longitudinal position of 105 mm from the longitudinal center is larger than that at the longitudinal center by about 105 μm. Therefore, different from the case where the pressing roller A is used, the friction image is not generated.

That is, when the temperature control of the heater 16 is uniformly effected irrespective of a cumulative amount of use of the fixing apparatus, it was found that the paper crease can be suppressed but a disadvantage due to the excessively large reverse crown amount occurs.

Therefore, the fixing apparatus in this embodiment effects the temperature control of the heater 16 depending on the cumulative amount of use of the fixing apparatus to maintain a proper reverse crown shape of the pressing roller, so that the paper crease is suppressed without causing the image defect or the like.

(8) Energization Ratio Change Control

In this embodiment, as the cumulative amount of use of the fixing apparatus, a cumulative sheet number of sheets of the recording material P passed through the fixing nip Nt is used. On the basis of the cumulative sheet number, a decrease of the reverse crown amount of the pressing roller 22 in the room temperature state is predicted.

In the case where the decrease of the reverse crown amount of the pressing roller 22 in the room temperature state is predicted, the energization ratio of the energization to the second energization heat generating resistor layer 102 to the energization to the first energization heat generating resistor layer 102 until the time immediately before the recording material enters the fixing nip as shown in Table 1 was changed.

Further, the energization ratio is set at a value so as not to cause the above-described disadvantage such as the occurrence of the friction image even in the case where the recording material is passed through the fixing nip from the state in which the fixing apparatus 12 is sufficiently warmed. Here, the cumulative sheet number refers to a count value obtained by adding the number of sheets of the recording material P passed through the fixing nip Nt after the recording material P is first passed through the fixing nip Nt when the fixing apparatus 12 is in a brand-new state. For example, in the case where a new fixing operation of the recording material P is now performed, when a first sheet of the recording material P in a job for performing the fixing operation is a 10,000-th sheet of the recording material P which has already been passed through the fixing nip Nt, at that time, the cumulative sheet number of the recording material P is 9,999 sheets.

Here, a relationship between the cumulative sheet number of the sheets of the recording material P passed through the fixing nip Nt of the fixing apparatus 12 and the reverse crown amount of the pressing roller 22 in the room temperature state is shown in FIG. 12. In FIG. 12, the reverse crown amount (μm) of the pressing roller 22 is the ordinate, and the cumulative sheet number (sheets) of the sheets of the recording material P passed through the fixing nip Nt is the abscissa. The reverse crown amount shown in FIG. 12 is that at the position spaced from the longitudinal center of the pressing roller 22 by 105 mm with respect to the longitudinal direction.

As shown in FIG. 12, it is understood that the reverse crown amount of the pressing roller 22 is linearly decreased with an increasing cumulative sheet number of the recording material P passed through the fixing nip Nt. The reverse crown amount of the pressing roller 22 shown in FIG. 12 is a measurement result of continuous passing of sheets of the recording material of the same type in the case where the pressing roller which is brand new and unused and has the outer diameter, at the position spaced from the longitudinal center by 105 mm with respect to the longitudinal direction, which is larger than the longitudinal center outer diameter by 105 μm is used. The recording material used is a LTR-sized plain paper of 75 $g/m_2$ in basis weight.

In accordance with the result of FIG. 12, the energization ratio (%) of the energization to the second energization heat generating resistor layer 103 to the energization to the first energization heat generating resistor layer 101 was set, depending on the cumulative sheet number of sheets of the recording material passed through the fixing nip, as shown in Table 2.

TABLE 2

| C.S.N.*$_1$ | I.B.E.*$_2$ | 1-50 | 51-100 | 101- |
|---|---|---|---|---|
| 0-50,000 | 100% | 100% | 90% | 80% |
| 50,001-100,000 | 110% | 100% | 90% | 80% |
| 100,001-150,000 | 120% | 100% | 90% | 80% |
| 150,001-200,000 | 130% | 100% | 90% | 80% |
| 200,001- | 140% | 100% | 90% | 80% |

*$_1$"C.S.N." represents the cumulative sheet number (sheets).

*$_2$"I.B.E." represents until the time immediately before entering of the recording material into the fixing nip.

In Table 2, the cumulative sheet numbers "0-50,000", "50,001-100,000", "100,001-150,000", "150,001-200,000" and "200,001-" are energization-changing cumulative sheet numbers. The energization-changing cumulative sheet number refers to a set cumulative sheet number in which the outer diameter difference of the pressing roller 22 with respect to the longitudinal direction in the recording material conveyance region is capable of being kept in a predetermined (certain) range so that the occurrence of the paper crease and the occurrence of the friction image can be suppressed.

In this embodiment, energization ratio-changing control in the fixing apparatus 12 will be described based on a specific example. The energization ratio-changing control described below is effected by an energization controller 30. FIG. 13 is a flow chart of the energization-changing control by the energization controller 30.

In FIG. 13, in S1, an output signal from a recording material passing sensor 33 provided in the neighborhood of a recording material discharge opening through which the recording material passing through the fixing nip Nt of the fixing apparatus 12 is conveyed in the recording material conveyance direction is obtained.

In S2, the output signal from the recording material passing sensor 33 is counted to add up the number of sheets of the recording material P passed through the fixing nip Nt.

In S3, discrimination as to whether the added-up number (cumulative sheet number) of the recording material is a predetermined energization ratio-changing cumulative sheet number or more is made. When the cumulative sheet number is the predetermined energization ratio-changing cumulative sheet number or more, the operation goes to S4.

In S4, the energization ratio, between the first and second energization heat generating resistor layers 101 and 102, corresponding to the predetermined energization ratio-changing cumulative sheet number is obtained. Then, the energization controller 30 controls the first triac 31 and the second triac 32 so that the triacs 31 and 32 independently energize the first and second energization heat generating resistor layers 101 and 102, respectively, with an energization amount corresponding to the energization ratio.

As a result, the energization to the first energization heat generating resistor layer 101 and the energization to the second energization heat generating resistor layer 102 are independently controlled, so that the amount of heat generation per unit length is changeable with respect to the longitudinal direction of the heater 16.

Here, processing in S3 and S4 will be described specifically. In the case where the fixing apparatus 12 is operated from the room temperature state, in most of a period from receiving of an image formation start signal (rising of the heater 16) until immediately before the recording material P enters the fixing nip, all of suppliable electric power is supplied to the first and second energization heat generating resistor layers 101 and 102 of the heater 16. In this embodiment, about 1000 W is supplied.

Here, in the case where the cumulative sheet number in Table 2 is 0-50,000 sheets, the energization ratio of the energization to the second energization heat generating resistor layer 102 to the energization to the first energization heat generating resistor layer 101 is 100%. In this case, the same electric power is supplied to each of the first and second energization heat generating resistor layers 101 and 102, Specifically, about 500 W is supplied to each of the first and second energization heat generating resistor layers 101 and 102, so that 1000 W is total is supplied to these layers.

Further, in the case where the cumulative sheet number in Table 2 is 200,001 sheets or more, the energization ratio of the energization to the second energization heat generating resistor layer 102 to the energization to the second energization heat generating resistor layer 101 is 140%. In this case, the electric power supplied to the first energization heat generating resistor layer 101 is about 420 W. The electric power supplied to the second energization heat generating resistor layer 102 is about 580 W. That is, with the energization ratio (duty ratio), of the energization to the second energization heat generating resistor layer 102 to the energization to the first energization heat generating resistor layer 101, of 140%, about 1000 W in total is supplied to the first and second energization heat generating resistor layers 101 and 102.

In the following, also during the sheet passing, the energization ratio in Table 2 is that of the energization to the second energization heat generating resistor layer 102 to the first energization heat generating resistor layer 101. Further, the amount of the energization to each of the two energization heat generating resistor layers 101 and 102 is determined so as to provide the energization ratio shown in Table 2 within a range of not exceeding 1000 W in total as the electric power supplied to the two energization heat generating resistor layers 101 and 102.

Then, an energization amount-changing command signal corresponding to the determined energization amount is outputted to the first triac 31 and the second triac 32. As a result, the first triac 31 energizes the first energization heat generating resistor layer 101 with the duty ratio depending on the energization amount-changing command signal, and the second triac 32 energizes the second energization heat generating resistor layer 102 with the duty ratio depending on the energization amount-changing command signal.

With the energization ratio shown in Table 2, the energization to each of the first and second energization heat generating resistor layers 101 and 102 is controlled. As a result, even when the recording material P is passed through the fixing nip from the state in which the fixing apparatus 12 is sufficiently cooled to the room temperature state, even in the case where the cumulative sheet number of the recording material passed through the fixing nip in the fixing apparatus 12 is large and thus the reverse crown amount of the pressing roller at the longitudinal end portion in the room temperature state is small, the reverse crown shape of the pressing roller immediately before the recording material enters the fixing nip can be properly maintained by the thermal expansion of the pressing roller and therefore the occurrence of the paper crease can be suppressed.

In this embodiment, the energization ratio of the energization to the second energization heat generating resistor layer 102 to the energization to the first energization heat generating resistor layer 101 is changed depending on the cumulative sheet number of the recording material P only in the period from the receiving of the image formation start signal (the rising of the heater 16) until the recording material P enters the fixing nip.

This is because the heater control by which the amount of heat generation of the heater 16 at the longitudinal end portion is larger than that at the longitudinal central portion is continued even in a period in which the recording material P is fixed in the fixing nip Nt, a degree of the non-sheet-passing portion temperature rise is worsened and thus there is a possibility that the fixing property is adversely affected.

However, in the case where the proper reverse crown shape is not obtained even when the above-described heater control is effected in the period from the rising of the heater 16 until the recording material P enters the fixing nip, the heater control may also be continued also during the fixing process. The heater control is effected in the period from the rising of the heater 16 until the recording material P enters the fixing nip and correspondingly a period in which the heater control is effected during the fixing process can be reduced in time, so that the disadvantage can be minimized.

In the case where the fixing film heating type in this embodiment is used, the pressing roller 22 is urged against the fixing film 20 toward the heater 16 and therefore the heat of the heater 16 is easily transferred to the pressing roller 22, so that the pressing roller can be expanded in a short time.

Further, when the outer diameter shape of the pressing roller 22 can be changed to a proper reverse crown shape once during the continuous sheet passing the recording material P, thereafter even when the recording material P is continuously passed through the fixing nip, the paper crease is not generated.

In this embodiment, the case where the LTR-sized recording material is passed through the fixing nip is described but in the case where the width of the recording material to be passed through the fixing nip is already known, the energization ratio, of the energization to the second energization heat generating resistor layer 102 to the energization to the first energization heat generating resistor layer 101, shown in Table 2 may be set correspondingly to the recording material width.

Further, by using the output signal of the recording material sensor 33, the cumulative sheet number of the recording material passed through the fixing nip Nt is obtained but the number of sheets subjected to image formation inputted by a user may also be used as the cumulative sheet number of the recording material. Alternatively, the cumulative sheet number of the recording material may also be calculated by using a relationship between the rotation number of the pressing roller 22 or the fixing film 20 and the length of the recording material with respect to the recording material conveyance direction.

In this embodiment, as the cumulative amount of use of the fixing apparatus 12, the cumulative sheet number of the recording material passed through the fixing nip in the fixing apparatus 12 is used but a cumulative time of operation of the fixing apparatus 12 may also be used.

In the case where the recording material having a width narrower than that of the LTR size, such as A4 size or B5 size, is passed through the fixing nip, the energization ratio of the energization to the second energization heat generating resistor layer 102 to the energization to the first energization heat generating resistor layer 101 until immediately before the recording material enters the fixing nip is set at a value higher than that during the sheet passing. Thus, by setting the energization ratio itself correspondingly to the recording material width, it is possible to obtain the effect of suppressing the occurrence of the paper crease similarly as in the case where the LTR-sized recording material is passed through the fixing nip as described above.

According to this embodiment, the longitudinal heat generation distribution of the heater until immediately before the recording material enters the fixing nip can be optimized and the reverse crown shape can be made proper by the thermal expansion of the pressing roller, so that the occurrence of the paper crease can be suppressed irrespective of the cumulative amount of use of the fixing apparatus.

Embodiment 2

A second exemplary embodiment is described.

Another example of the fixing apparatus 12 will be described. In the fixing apparatus 12 in this embodiment, the energization ratio of the energization to the second energization heat generating resistor layer 102 to the energization to the first energization heat generating resistor layer 101 of the heater 16 is set on the basis of thermal history, not the cumulative sheet number of the recording material passed through the fixing nip.

In Embodiment 1, the gradual decrease in reverse crown amount of the pressing roller 22 when the cumulative sheet number of the recording material P passed through the fixing nip in the fixing apparatus 12 is increased is described.

However, accurately, it has been known that the reverse crown amount is decreased more quickly in the case where the pressing roller 22 is used in a higher temperature state even when the cumulative sheet number of the recording material P is the same.

Here, as the case where the recording material P is passed through the fixing nip in the high temperature state of the pressing roller 22, e.g., the case where a narrow-width recording material P is passed through the fixing nip is cited. That is, as in this embodiment, in the case where a maximum width of a passable recording material P is the LTR size (216 mm), the case where the sheet passing of the recording material P of A4 size, B5 size, A5 size or the like is effected is cited.

In the case where such a narrow-width recording material P is passed through the fixing nip, compared with the width of the recording material P, the length of the first and second energization heat generating resistor layers 101 and 102 on the heater 16 is long and therefore the degree of the non-sheet-passing portion temperature rise is large. Further, the width of the recording material P is also smaller than the length of the pressing roller 22 and therefore the heat of the heater 16 is transferred to the pressing roller 22 via the fixing film 20 without being taken by the recording material P. For that reason, the longitudinal end portion of the pressing roller 22 is used in the high-temperature state. As a result, compared with the case where the LTR-sized recording material P is passed through the fixing nip, the decrease in reverse crown amount of the pressing roller 22 is fast.

Further, even in the case where the same width recording material P is passed through the fixing nip, the temperature of the pressing roller 22 particularly at the longitudinal end portion varies also depending on the thickness, the basis weight of the recording material P subjected to the sheet passing.

In this embodiment, different from the case where the cumulative sheet number of the sheets of the recording material passed through the fixing nip is simply added up as in Embodiment 1, the heat quantity supplied to the pressing roller is predicted and on the basis of the predicted value, the energization ratio of the energization to the second energization heat generating resistor layer 102 to the energization to the first energization heat generating resistor layer 101 on the heater 16 is set.

In this embodiment, the constitution of the image forming apparatus is the same as that of the image forming apparatus in Embodiment 1, and the constitution of the fixing apparatus 12 is also the same as that of the fixing apparatus 12 in Embodiment 1 and therefore these constitutions will be omitted from redundant description.

In the fixing apparatus 12, in this embodiment, on the back surface of the substrate 100 of the heater 16, the sub-thermistors 19*a* and 19*b* are disposed at left and right positions of 99 mm from the longitudinal center, and the temperature of the heater 16 is detected by these sub-thermistors 19*a* and 19*b*. That is the fixing apparatus 12 in this embodiment has the same constitution as that of the fixing apparatus 12 in Embodiment 1 except that the temperature of the heater 16 is detected by the sub-thermistors 19*a* and 19*b*.

The detection temperatures of the sub-thermistors 19*a* and 19*b* in the case where 500 sheets of each of the LTR-sized recording material, the A4-sized recording material and the B5-sized recording material are continuously passed through the fixing nip of the fixing apparatus 12 in this embodiment are shown in Table 3.

TABLE 3

| Size | 1st-sheet | 500th-sheet |
|---|---|---|
| LTR | 219° C. | 221° C. |
| A4 | 230° C. | 235° C. |
| B5 | 235° C. | 255° C. |

The width of the LTR-sized recording material is 216 mm. The width of the A4-sized recording material is 210 mm. The width of the B5-sized recording material is 182 mm. These recording materials are plain papers of 75 g/$m_2$ different in size. The sheet passing speed (rate) of the LTR-sized recording material and the A4-sized recording material was 50 sheets/min (40 ppm) at the conveyance speed of 240 mm/sec. In the case of the B5-sized recording material, a condition for preventing the non-sheet passing portion temperature rise is severe at 400 ppm and therefore the sheet passing speed was 20 sheets/min at the same conveyance speed.

In Table 3, during 500 sheets of continuous sheet passing of each of the recording materials, a maximum of the detection temperatures of the sub-thermistors 19*a* and 19*b* when each of the first sheet and the 500th sheet is passed through the fixing nip of the fixing apparatus is shown. Further, the sub-thermistors 19*a* and 19*b* are disposed bilaterally with respect to the longitudinal center on the heater 16 and therefore the detection temperatures thereof are substantially the same. For that reason, in Table 3, an average of the detection temperatures of the sub-thermistors 19*a* and 19*b* is shown.

As shown in Table 3, with a narrower width of the recording material subjected to the sheet passing by the fixing apparatus 12, the detection temperature of the sub-thermistors 19*a* and 19*b* becomes higher. Further, in the case where the recording material is continuously passed through the fixing nip, with the narrower width of the recording material, an increase of the maximum (average) detection temperature of the sub-thermistors 19*a* and 19*b* at the final stage to the initial stage is larger.

In the case of the LTR-sized recording material, during the continuous sheet passing on 500 sheets, with respect to any number of sheets subjected to the sheet passing, the maximum of the detection temperature of the sub-thermistors 19*a* and 19*b* was substantially constant at 221° C. The detection temperature of the sub-thermistors 19*a* and 19*b* varies depending on the size of the recording material as shown in Table 3. This means that the heat quantity supplied to the pressing roller 22 also varies depending on the size of the recording material. Although the temperature of the pressing roller 22 itself is not measured, as the prediction of the heat quantity supplied to the pressing roller 22, the detection temperature of the sub-thermistors 19*a* and 19*b* is effective.

The above result shows the following. That is, in the case where only the LTR-sized recording material is subjected to the sheet passing, thermal history of the pressing roller 22 (particularly at the longitudinal end portion) is proportional to the cumulative sheet number of the sheets of the recording material passed through the fixing nip. However, in the case where the sheets of the LTR-sized recording material and the narrower-width recording material are passed through the fixing nip, it is difficult to predict the thermal history of the pressing roller 22 from only the cumulative sheet number of the recording material.

Further, in the case where the energization control depending on the cumulative sheet number is effected, when the narrow-width recording material is passed in a large amount through the fixing nip in preceding sheet passing, the speed of the decrease in reverse crown amount of the pressing roller 22 is fast compared with an estimated speed, so that there was the case where the occurrence of the paper crease cannot be suppressed.

From the above results, in this embodiment, as the thermal history of the pressing roller 22, Th=(maximum detection temperature of sub-thermistors during sheet passing of one sheet of recording material)/100 is used, and Th is added up every sheet passing of one sheet of the recording material. This cumulative value is hereinafter referred to as a thermal history cumulative count.

That is, in the case where 100 sheets of the LTR-sized recording material are continuously passed through the fixing nip, Th=220/100=2.2 and therefore as the thermal history cumulative count, 2.2×100=220 is added.

Depending on the above thermal history cumulative count, as shown in Table 4 below, the energization ratio (%) of the energization to the second energization heat generating resistor layer 102 to the energization to the first energization heat generating resistor layer 101 of the heater 16 in the fixing apparatus 12 in this embodiment was set similarly as in Embodiment 1. Further, Table 4 shows the case where sheets of the LTR-sized recording material P are newly passed through the fixing nip on the basis of the thermal history cumulative count in Table 4.

TABLE 4

| T.H.C.C.*1 | I.B.E.*2 | 1-50 | 51-100 | 101- |
|---|---|---|---|---|
| 0-110,000 | 100% | 100% | 90% | 80% |
| 110,001-220,000 | 110% | 100% | 90% | 80% |
| 220,001-330,000 | 120% | 100% | 90% | 80% |
| 330,001-440,000 | 130% | 100% | 90% | 80% |
| 440,001- | 140% | 100% | 90% | 80% |

*1"T.H.C.C." represents the thermal history cumulative count.

*2"I.B.E." represents until the time immediately before entering of the recording material into the fixing nip.

In Table 2, the cumulative sheet numbers "0-110,000", "110,001-220,000", "220,001-330,000", "330,001-440,000" and "440,001-" are energization-changing cumulative counts. The energization-changing cumulative count refers to a thermal history-changing cumulative value in which the outer diameter difference of the pressing roller 22 with respect to the longitudinal direction in the recording material conveyance region is capable of being kept in a predetermined (certain) range so that the occurrence of the paper crease and the occurrence of the friction image can be suppressed.

In this embodiment, energization ratio-changing control in the fixing apparatus 12 will be described. The energization ratio-changing control described below is effected by an energization controller 30. FIG. 14 is a flow chart of the energization-changing control by the energization controller 30.

In FIG. 14, in S11, an output signal from the sub-thermistors 19*a* and 19*b* is obtained.

In S12, on the basis of the output signal from the sub-thermistors 19*a* and 19*b*, the thermal history cumulative count is obtained.

In S13, discrimination as to whether the thermal history cumulative count obtained in S12 is a predetermined energization ratio-changing cumulative count or more is made. When the thermal history cumulative count is the predetermined energization ratio-changing cumulative count or more, the operation goes to S14.

In S14, the energization ratio, between the first and second energization heat generating resistor layers 101 and 102, corresponding to the predetermined energization ratio-changing cumulative count is obtained. Then, the energization controller 30 controls the first triac 31 and the second triac 32 so that the triacs 31 and 32 independently energize the first and second energization heat generating resistor layers 101 and 102, respectively, with an energization amount corresponding to the energization ratio.

As a result, the energization to the first energization heat generating resistor layer 101 and the energization to the second energization heat generating resistor layer 102 are independently controlled, so that the amount of heat generation per unit length is changeable with respect to the longitudinal direction of the heater 16.

Here, processing in S13 and S14 will be described specifically. The thermal history cumulative count in Table 4 is, in the case where only the LTR-sized recording material is passed through the fixing nip, the same as the cumulative sheet number in Table 2 in Embodiment 1 since Th is 2.2. On the other hand, even when the LTR-sized recording material is passed through the fixing nip in the same number of sheets, in the case where the narrow-width recording material is passed through the fixing nip during the sheet passing of the LTR-sized recording material, the value of Th is larger than that during the sheet passing of only the LTR-sized recording material, so that the thermal history cumulative count is increased early.

Compared with the sheet passing of only the LTR-sized recording material, in the case where not only the LTR-sized recording material but also the narrow-width recording material are passed through the fixing nip, the longitudinal end portion outer diameter of the pressing roller 22 is smaller but the thermal history cumulative count becomes a larger value. For that reason, the change of the level of the energization ratio is also made earlier than that of the change depending on the cumulative sheet number. Therefore, even in the case where the narrow-width recording material is passed in the large number through the fixing nip, it is possible to accurately suppress the occurrence of the paper crease.

Here, the result of Table 4 is an example of the case where sheets of the LTR-sized recording material are newly passed through the fixing nip from the state of the thermal history cumulative count. Similarly as in Embodiment 1, in the case where it is known that the recording material P having the size such as A4 size or B5 size is passed through the fixing nip, the energization ratio of the energization to the second energization heat generating resistor layer to the energization to the first energization heat generating resistor layer until immediately before the recording material enters the fixing nip is set at a value higher than that during the sheet passing. Thus, by setting the energization ratio itself correspondingly to the recording material width, it is possible to obtain the paper crease suppressing effect similarly as in the case where the LTR-sized recording material is passed through the fixing nip as described above.

Embodiment 3

A third exemplary embodiment is described.

Also in this embodiment, the constitution of the image forming apparatus is the same as that of the image forming apparatus in Embodiment 1, and the constitution of the fixing apparatus 12 is also the same as that of the fixing apparatus 12 in Embodiment 1 and therefore these constitutions will be omitted from redundant description.

In this embodiment, an example of the case where the narrow-width recording material P is passed through the fixing nip Nt and thereafter the recording material P having a width broader than that of the narrow-width recording material P is passed through the fixing nip Nt will be described.

As also described in Embodiment 2, in the case where the narrow-width recording material is passed through the fixing nip, by the influence of the non-sheet-passing portion temperature rise, both of the detection temperature of the sub-thermistors 19*a* and 19*b* and the longitudinal end portion temperature of the pressing roller 22 are higher than those in the case where the broad-width recording material is passed through the fixing nip.

Thus, in the case where the broad-width recording material is passed through the fixing nip immediately after the narrow-width recording material is passed through the fixing nip, when the energization ratio of the energization to the second energization heat generating resistor layer to the energization to the first energization heat generating resistor layer is changed, the image defect was caused in some cases. That is, although the paper crease was not generated, the friction image with the fixing film 20 surface due to excessive high conveyance speed of the recording material at the initial stage of the recording material sheet passing was generated in some cases.

In the case where the cumulative sheet number of the recording material passed through the fixing nip is large or the thermal history cumulative count is large, the outer diameter difference between the longitudinal end portion and the longitudinal central portion of the pressing roller 22 is small. However, after the narrow-width recording material is passed through the fixing nip, the longitudinal end portion temperature of the pressing roller 22 becomes high by the influence of the non-sheet-passing portion temperature rise. For this reason, the longitudinal end portion outer diameter of the pressing roller is also not less than that in the brand-new state.

From this state, when the broad-width recording material P is passed through the fixing nip while effecting the energization control as described in Embodiment 1 and Embodiment 2, the outer diameter difference between the longitudinal central portion and the longitudinal end portion of the pressing roller 22 becomes excessively large. For that reason, the disadvantage such as the friction image with the fixing film 20 surface was caused in some cases.

In this embodiment, in the case where after the narrow-width recording material is passed through the fixing nip, when the recording material having the width larger than the width of the immediately-preceding recording material is passed through the fixing nip in a predetermined time, irrespective of the cumulative sheet number at that time, the energization to the first and second energization heat generating resistor layers 101 and 102 is performed with an initial energization ratio setting.

Alternatively, in the case where after the narrow-width recording material is passed through the fixing nip, when the recording material having the width larger than the width of the immediately-preceding recording material is passed through the fixing nip in a predetermined time, irrespective of the thermal history cumulative count at that time, the energization to the first and second energization heat generating resistor layers 101 and 102 is performed with an initial energization ratio setting. The predetermined time refers to a set time in which the outer diameter difference of the pressing roller 22 with respect to the longitudinal direction in the recording material conveyance region is capable of being kept in a predetermined (certain) range so that the occurrence of the paper crease and the occurrence of the friction image can be suppressed.

That is, in the case where the sheet passing of the broad-width recording material is effected within 1 minute, which is the predetermined time, after the sheet passing of the narrow-width recording material, the energization to the first and second energization heat generating resistor layers 101 and 102 is effected with the initial energization ratio setting. Here, the initial energization setting refers to the cumulative sheet number in Table 2 or that in the case where the thermal history cumulative count in Table 4 is minimum.

In such a case, even when the energization control as described in Embodiment 1 and Embodiment 2 is not effected, the reverse crown shape of the pressing roller 22 is made at a certain level or more by the immediately-preceding sheet passing of the narrow-width recording material and therefore the paper crease is not generated. Further, the energization control until immediately before the broad-width recording material enters the fixing nip is effected with the initial setting and therefore the amount of heat generation of the pressing roller 22 at the longitudinal end portion is not excessively increased. As a result, the occurrence of the image defect due to the excessively large outer diameter difference between the longitudinal central portion and the longitudinal end portion of the pressing roller 22 can be suppressed.

In the fixing apparatus 12 in this embodiment, e.g., when the broad-width recording material is passed through the fixing nip, the energization controller 30 monitors the detection temperature of the sub-thermistors 19*a* and 19*b* immediately before the operation of the fixing apparatus 12. Further, in the case where the detection temperature is larger than a predetermined fixing temperature, the energization controller 30 discriminates that the narrow-width recording material is passed through the fixing nip immediately before the sheet passing of the broad-width recording material, and effects the energization to the first and second energization heat generating resistor layers 101 and 102 with the same initial energization ratio setting.

Thus, the same functional effect can be obtained even when the energization to the first and second energization heat generating resistor layers 101 and 102 is effected with the same initial energization ratio setting on the basis of the detection temperature of the sub-thermistors 19*a* and 19*b*.

Further, in the case where the fixing apparatus has the constitution in which the temperature of the heater 16 is detected by the sub-thermistors 19*a* and 19*b* and the main thermistor 18 in combination as in Embodiment 1, the energization to the first and second energization heat generating resistor layers 101 and 102 may also be performed with the same initial energization ratio setting. That is, from the difference between the detection temperature of the sub-thermistors 19*a* and 19*b* and the detection temperature of the main thermistor 18, when the longitudinal end portion temperature of the pressing roller is discriminated as being significantly high, the energization to the first and second energization heat generating resistor layers 101 and 102 is performed with the same initial energization ratio setting.

Thus, on the basis of the detection temperature of the sub-thermistors 19*a* and 19*b* and the detection temperature of the main thermistor 18, even when the energization to the first and second energization heat generating resistor layers 101 and 102 is performed with the same initial energization ratio setting, the same functional effect can be achieved.

In Embodiments 1 to 3, as an example of the heater 16, as shown in FIG. 3, the heater having the constitution in which at least two energization heat generating resistor layers 101 and 102 are disposed, in parallel to each other with respect to the recording material conveyance direction, so as to extend in the longitudinal direction perpendicular to the recording material conveyance direction was described.

However, the heater 16 is not limited to that having the constitution shown in FIG. 3. For example, the first energization heat generating resistor layer 101 is not necessarily required to have the substantially uniform resistance value per unit length with respect to the longitudinal direction. Further, the second energization heat generating resistor layer 102 may also have a constitution, as shown in (a) of FIG. 15, in which only the longitudinal end portions 102*e* generate heat and the longitudinal central portion is an electroconductive layer.

Further, as shown in (b) of FIG. 15, the heater 16 may also have a tapered shape such that the width of each of the first and second energization heat generating resistor layers 101 and 102 is gradually charged while being close to each other. The first energization heat generating resistor layer 101 is continuously increased in width toward the longitudinal end and thus the resistance value per unit length is correspondingly decreased, so that the amount of heat generation at the longitudinal central portion is large. The second energization heat generating resistor layer 102 is continuously decreased in width toward the longitudinal end and thus the resistance value per unit length is correspondingly increased, so that the amount of heat generation at the longitudinal end portion is large.

In Embodiments 1 to 3, the example in which the temperature of the heater 16 is detected by the sub-thermistors 19*a* and 19*b* is described but the sub-thermistors 19*a* and 19*b* may also be configured to detect the temperature of the fixing film 20. In this case, similarly as in the case of the main thermistor 18, the sub-thermistors 19 and 19*b* are attached to the end of the arm 25 in contact with the inner surface of the fixing film 20.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 124162/2011 filed Jun. 2, 2011, which is hereby incorporated by reference.

What is claimed is:

1. A fixing apparatus for fixing a toner image on a recording material by heating the toner image while conveying the recording material in a nip, said fixing apparatus comprising:

a pair of rotatable members configured to form the nip, wherein at least one of said pair of rotatable members has a region where an outer diameter is increased from a longitudinal central portion toward a longitudinal end portion;

a heater, having a variable heat generation distribution with respect to a longitudinal direction, configured to heat said pair of rotatable members;

a controller configured to control the heat generation distribution of said heater with respect to the longitudinal direction, and a counting portion configured to count the amount of use of said fixing apparatus from a time of a brand-new state thereof to determine the cumulative amount of use of said fixing apparatus, wherein said controller sets a ratio of an amount of heat generation at the longitudinal end portion to that at the longitudinal central portion at a first ratio in a period from the start of electric power supply to said heater until the recording material reaches the nip when the cumulative amount of use is smaller than a predetermined threshold, and sets the ratio at a second ratio larger than the first ratio in the period when the cumulative amount of use is larger than the predetermined threshold.

2. An apparatus according to claim 1, wherein said pair of rotatable members comprises a cylindrical film and a pressing roller having the region where the outer diameter is increased from the longitudinal central portion toward the longitudinal end portion.

3. An apparatus according to claim 2, wherein said heater is contacted to an inner surface of the film, and the nip is formed between the film and the pressing roller.

4. An apparatus according to claim 1, wherein said heater includes a first heat generating resistor having an amount of heat generation which is larger at a longitudinal central portion than that at a longitudinal end portion and a second heat generating resistor having an amount of heat generation which is larger at the longitudinal end portion than that at the longitudinal central portion.

5. An apparatus according to claim 1, wherein the cumulative amount of use is a cumulative number of sheets of the recording material subjected to a fixing process by said fixing apparatus.

6. An apparatus according to claim 1, wherein the cumulative amount of use is a cumulative time of an operation of said fixing apparatus.

7. A fixing apparatus for fixing a toner image on a recording material by heating the toner image while conveying the recording material in a nip, said fixing apparatus comprising:

a pair of rotatable members configured to form the nip, wherein at least one of said pair of rotatable members has a region where an outer diameter is increased from a longitudinal central portion toward a longitudinal end portion;

a heater, having a variable heat generation distribution with respect to a longitudinal direction, configured to heat said pair of rotatable members; and a controller configured to control the heat generation distribution of said heater with respect to the longitudinal direction, wherein said controller is configured to control said heater so that the heat generation distribution of said heater is such that an amount of heat generation at the longitudinal end portion is larger than that at the longitudinal central portion at least in a period from start of said heater until the recording material reaches the nip, wherein a ratio of the amount of heat generation at the longitudinal end portion to that at the longitudinal central portion is larger when a cumulative number of the thermal history of said fixing apparatus is larger than a predetermined amount than when the cumulative number of the thermal history is smaller than the predetermined amount.

8. An apparatus according to claim 7, wherein said pair of rotatable members comprises a cylindrical film and a pressing roller having the outer diameter increased from the longitudinal central portion toward the longitudinal end portion.

9. An apparatus according to claim 8, wherein said heater is contacted to an inner surface of the film, and the nip is formed between the film and the pressing roller.

10. An apparatus according to claim 7, wherein said heater includes a first heat generating resistor having an amount of heat generation which is larger at a longitudinal central portion than that at a longitudinal end portion and a second heat generating resistor having an amount of heat generation which is larger at the longitudinal end portion than that at the longitudinal central portion.

11. An apparatus according to claim 7, further comprising a temperature detecting portion configured to detect the temperature of said heater or said pair of rotatable members at an associated longitudinal end portion, wherein the cumulative number of the thermal history is a cumulative number of a coefficient depending on the temperature detected by said detecting portion during passage of one sheet of the recording material through the nip.

12. An apparatus according to claim 1, wherein the second ratio is larger than 1.

13. An apparatus according to claim 12, wherein the first ratio is larger than 1.

14. A fixing apparatus for fixing a toner image on a recording material by heating the toner image while conveying the recording material in a nip, said fixing apparatus comprising:

a pair of rotatable members configured to form the nip, wherein at least one of said pair of rotatable members has a region where an outer diameter is increased from a longitudinal central portion toward a longitudinal end portion;

a heater, having a variable heat generation distribution with respect to a longitudinal direction, configured to heat said pair of rotatable members;

a controller configured to control the heat generation distribution of said heater with respect to the longitudinal direction, and a counting portion configured to count the amount of use of said fixing apparatus from a time of a brand-new state thereof to determine the cumulative amount of use of said fixing apparatus, wherein said controller sets, depending on the cumulative amount of use, a ratio of an amount of heat generation at the longitudinal end portion to that at the longitudinal central portion in a period from the start of electric power supply to said heater until the recording material reaches the nip.

15. A fixing apparatus for fixing a toner image on a recording material by heating the toner image while conveying the recording material in a nip, said fixing apparatus comprising:

a pair of rotatable members configured to form the nip, wherein at least one of said pair of rotatable members has a region where an outer diameter is increased from a longitudinal central portion toward a longitudinal end portion;

a heater, having a variable heat generation distribution with respect to a longitudinal direction, configured to heat said pair of rotatable members; and a controller configured to control the heat generation distribution of said heater with respect to the longitudinal direction, wherein said controller sets, depending on the cumulative amount of use of said fixing apparatus before start of fixing and before electric power supply to said heater, a ratio of an amount of heat generation at the longitudinal end portion to that at the longitudinal central portion in a period from the start of electric power supply to said heater until the recording material reaches the nip.

16. An image forming apparatus for forming a toner image on a recording material, the image forming apparatus comprising:

an image forming portion configured to form the toner image;

a fixing portion configured to fix the toner image on the recording material by heating the toner image while conveying the recording material in a nip, the fixing portion having a pair of rotatable members forming the nip, and a heater configured to heat the pair of rotatable members; and a controller configured to control a heat generation distribution of the heater with respect to the longitudinal direction, wherein at least one of the pair of rotatable members has a region where an outer diameter is increased from a longitudinal central portion toward a longitudinal end portion, and wherein the heat generation distribution in a period, of a print job, from the start of electric power supply to said heater until the recording material reaches the nip is set depending on a cumulative amount of use of said fixing portion at a time of the start of the print job.

17. An apparatus according to claim 16, wherein said controller sets a ratio of an amount of heat generation at the longitudinal end portion to that at the longitudinal central portion at a first ratio when the cumulative amount of use of said apparatus is smaller than a predetermined threshold, and sets the ratio at a second ratio larger than the first ratio when the cumulative amount of use is larger than the predetermined threshold.

18. An apparatus according to claim 16, wherein the second ratio is larger than 1.

19. An apparatus according to claim 18, wherein the first ratio is larger than 1.

20. An apparatus according to claim 16, wherein the pair of rotatable members comprises a cylindrical film and a pressing roller having the region where the outer diameter is increased from the longitudinal central portion toward the longitudinal end portion.

21. An apparatus according to claim 20, wherein the heater is contacted to an inner surface of the film, and the nip is formed between the film and the pressing roller.

22. An apparatus according to claim 16, wherein the cumulative amount of use is the number of sheets of the recording material subjected to fixing.

23. A fixing apparatus for fixing a toner image on a recording material by heating the toner image while conveying the recording material in a nip, said fixing apparatus comprising:

a first rotatable member;

a second rotatable member forming the nip with the first rotatable member, the second rotatable member having a region where an outer diameter is increased from a longitudinal central portion toward a longitudinal end portion;

a heater configured to heat the first rotatable member, the heater having a variable heat generation distribution with respect to a longitudinal direction; and a controller configured to control the heat generation distribution of said heater with respect to the longitudinal direction, wherein said controller sets a ratio of an amount of heat generation at the longitudinal end portion to that at the longitudinal central portion in a period from the start of electric power supply to said heater until the recording material reaches the nip, depending on the amount of change of the difference in outer diameter between the longitudinal end portion and the longitudinal central portion due to plastic deformation of said second rotatable member.

24. A fixing apparatus for fixing a toner image on a recording material by heating the toner image while conveying the recording material in a nip, said fixing apparatus comprising:

a pair of rotatable members configured to form the nip, wherein at least one of said pair of rotatable members has a region where an outer diameter is increased from a longitudinal central portion toward a longitudinal end portion;

a heater, having a variable heat generation distribution with respect to a longitudinal direction, configured to heat said pair of rotatable members; and a controller configured to control the heat generation distribution of said heater with respect to the longitudinal direction, wherein said controller sets, depending on the number of sheets of the recording material subjected to fixing by said fixing apparatus, a ratio of the amount of heat generation at the longitudinal end portion to that at the longitudinal central portion in a period from the start of electric power supply to said heater until the recording material reaches the nip.

* * * * *